US007108368B2

(12) United States Patent
Saito et al.

(10) Patent No.: US 7,108,368 B2
(45) Date of Patent: Sep. 19, 2006

(54) RECORDING APPARATUS

(75) Inventors: Hiroyuki Saito, Kanagawa (JP); Haruo Uchida, Kanagawa (JP); Nozomu Nishiberi, Kanagawa (JP); Koya Iwakura, Kanagawa (JP); Kentaro Onuma, Kanagawa (JP); Kenji Shigeno, Kanagawa (JP); Motoyuki Taguchi, Kanagawa (JP); Shinya Sonoda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 73 days.

(21) Appl. No.: 10/981,639

(22) Filed: Nov. 5, 2004

(65) Prior Publication Data

US 2005/0099480 A1 May 12, 2005

(30) Foreign Application Priority Data

Nov. 12, 2003 (JP) ..... 2003-382533
Aug. 18, 2004 (JP) ..... 2004-238446

(51) Int. Cl.
*B65H 3/00* (2006.01)

(52) U.S. Cl. ..... 347/104; 271/186

(58) Field of Classification Search ..... None
See application file for complete search history.

(56) References Cited

U.S. PATENT DOCUMENTS 4,526,361 A * 7/1985 DuBois ..... 271/186
5,531,436 A * 7/1996 Ohyama et al. ..... 271/275
5,561,500 A * 10/1996 Ohzeki et al. ..... 399/85
5,781,823 A * 7/1998 Isobe et al. ..... 399/2
6,032,949 A * 3/2000 Ando ..... 271/225
6,341,835 B1 * 1/2002 Ogawa et al. ..... 347/16
6,739,589 B1 * 5/2004 Hiramatsu ..... 271/184
2004/0239743 A1 * 12/2004 Ohashi et al. ..... 347/104

* cited by examiner

*Primary Examiner*—Andrew H. Hirshfeld
*Assistant Examiner*—Jill E. Culler
(74) *Attorney, Agent, or Firm*—Fitzpatrick, Cella, Harper & Scinto

(57) ABSTRACT

Disclosed is a recording apparatus that helps to achieve a reduction in size and cost. The recording apparatus has a U-turn sheet feeding mechanism for reversing and feeding a recording medium and a duplex transport mechanism for reversing the recording medium and performing printing on both sides thereof, in which the same transport path serves as a transport path for transporting the recording medium from a U-turn sheet feeding roller to a main transport roller for transporting the recording medium to a printing portion and as a transport path for reversal in duplex transport. Further, a transport roller provided in the transport path from the U-turn sheet feeding roller to the main transport roller for transporting the recording medium to the printing portion is the same as a transport roller for duplex transport. A single transport roller serves both as the U-turn transport roller and as the duplex transport roller.

13 Claims, 18 Drawing Sheets

RECORDING APPARATUS

BACKGROUND OF THE INVENTION

1. Field of the Invention

The present invention relates to a recording apparatus that performs recording on a recording sheet by a recording means.

2. Related Background Art

A conventional recording apparatus will be described with reference to FIG. 24.

In FIG. 24, reference numeral 901 indicates a recording head that performs recording by selectively discharging ink from a plurality of discharge ports. The recording head 901 is retained in position by a carriage (not shown), and reciprocates in a direction perpendicular to the conveying direction of a recording medium, thereby performing printing on the recording medium. Reference numeral 902 indicates a platen opposed to the recording head, and retains the recording medium at a printing portion.

Next, a U-turn feeding structure will be described.

Reference numeral 905 indicates a sheet feeding cassette that retains recording mediums in a stacked state, reference numeral 906 indicates a U-turn sheet feeding roller for separately conveying the recording mediums, reference numeral 910 indicates a paper guide on the inner side of a U-turn portion, reference numeral 911 indicates a paper guide on the outer side of the U-turn portion, reference numeral 907 indicates a U-turn transport roller, reference numeral 908 indicates a U-turn transport roller adapted to be driven to rotate while pressurizing the U-turn transport roller 907, reference numeral 903 indicates a transport roller pair for transporting the recording medium to a printing portion, reference numeral 913 indicates a paper guide for guiding the recording medium to the transport roller pair 903, reference numeral 904 indicates an ejection roller pair for ejecting the recording medium, and reference numeral 909 indicates an ejection tray retaining the ejected recording medium. Reference numeral 912 indicates a U-turn paper guide flapper for switching between U-turn transport and reversal transport for two-side recording.

Next, a U-turn sheet feeding operation will be described.

The recording mediums stacked in the sheet feeding cassette 905 are separately transported in the direction of the arrow M by the U-turn sheet feeding roller 906, further transported in the direction of the arrow N by the U-turn transport roller 907 and the U-turn transport roller 908, and transported in the direction of the arrow P while guided by the paper guides 910, 911, and 913. At this time, the U-turn paper guide flapper 912 moves in the direction of the arrow Q (indicated by the dashed line) to secure the U-turn transport path. Next, the recording medium is transported to the printing portion by the transport roller pair 903, and printing is effected by the recording head 901. Then, the recording medium is transported in the direction of the arrow U by the ejection roller pair 904, and ejected onto the ejection tray 909.

Next, a two-side printing structure will be described.

Reference numerals 914 and 915 indicate duplex transport rollers, reference numeral 916 indicates duplex transport rollers adapted to be driven to rotate while pressurizing the duplex transport rollers 914 and 915, reference numeral 917 indicates outer paper guides for duplex transport, reference numerals 918 and 919 indicate inner paper guides for duplex transport, and reference numeral 920 indicates a two-side paper guide flapper for switching the transport path before and after reversal in duplex transport.

Next, a two-side printing operation will be described.

Printing is performed by the recording head 901 on the recording medium fed by the U-turn sheet feeding mechanism; when the printing on the obverse side is completed, the transport roller pair 903 and the ejection roller pair 904 are reversed in rotation to transport the recording medium in the direction of the arrow R. The recording medium is further transported in the direction of the arrow S by the transport roller pair 903, and transported to a duplex transport portion. At this time, the U-turn paper guide flapper 912 moves in the direction of the arrow T, and the two-side paper guide flapper 920 moves in the direction of the arrow K, securing the transport path for the recording medium in the direction of the arrow S.

Further, the recording medium is transported by the duplex transport rollers 914 and 915 and the duplex transport rollers 916, and guided by the paper guides 917, 918, and 919 to be transported in the directions of the arrows H and I. The recording medium is transported again in the direction of the arrow P toward the transport roller pairs 903 in a reversed state. At this time, the two-side paper guide flapper 920 moves in the direction of the arrow L (indicated by the dashed line), securing the transport path after reversal. Printing is performed on the reverse side of the reversed recording medium by the recording head 1, and, when the printing is completed, the recording medium is ejected onto the ejection tray 909, thereby completing the two-side printing.

The above-described conventional example has the following problems.

Since the paper transport path is independent, mounting of the U-turn sheet feeding mechanism and the two-side printing mechanism results in an increase in the size of the apparatus main body in height direction and depth direction, thus hindering achievement of a reduction in size. Further, the provision of the independent transport mechanism leads to an increase in cost, which means the construction cannot be adopted in an inexpensive apparatus.

Further, to cope with jamming due to defective transport of a recording medium, it is necessary to provide a mechanism allowing opening of the paper guide portion; in this case also, the transport mechanism is independent, and the paper guide portion opening mechanism is also formed separately, which leads to an increase in apparatus size and cost.

SUMMARY OF THE INVENTION

It is an object of the present invention to provide a recording apparatus that helps to achieve a reduction in size and cost.

It is another object of the present invention to provide a recording apparatus comprising:

a U-turn sheet feeding roller for reversing and feeding a recording medium; a main transport roller for transporting the recording medium on an upstream side of a recording head; a reversing mechanism for turning the recording medium upside down; a first transport path for transporting the recording medium from the U-turn sheet feeding roller to the main transport roller; a second transport path for transporting the recording medium in the reversing mechanism, the second transport path sharing a portion thereof with the first transport path; and a third transport path arranged in the portion shared by the first and second transport paths and adapted to transport a recording medium of high rigidity.

DESCRIPTION OF THE PREFERRED EMBODIMENTS

In the following, embodiments of the present invention will be described with reference to the accompanying drawings.

[Embodiment 1]

Figure 1:
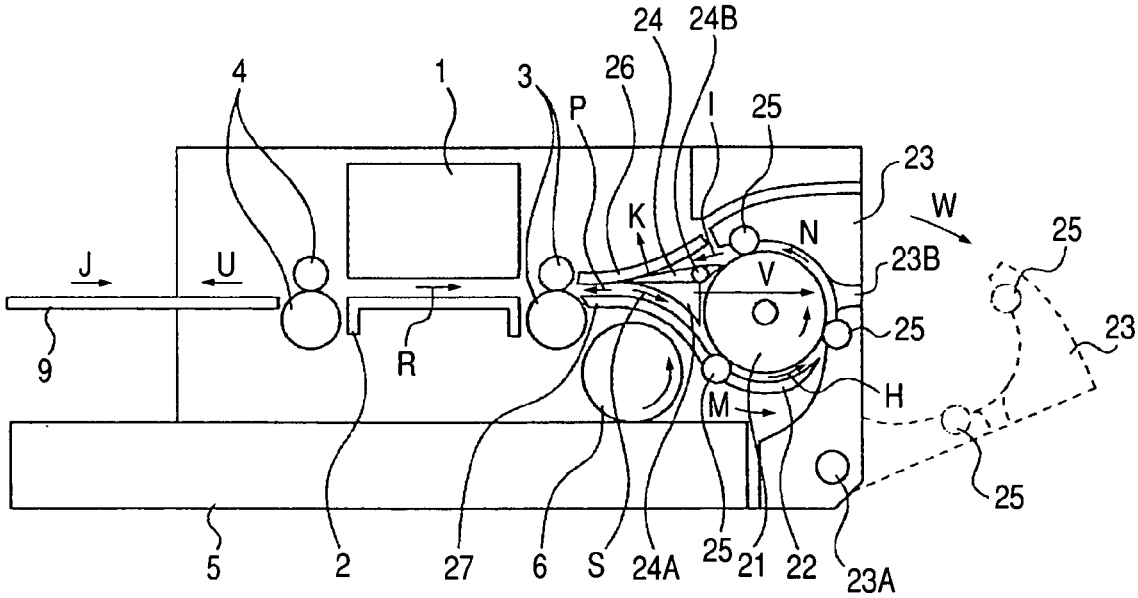
FIG. 1 is a sectional view of the main body of a recording apparatus according to Embodiment 1 of the present invention.
Figure 2:
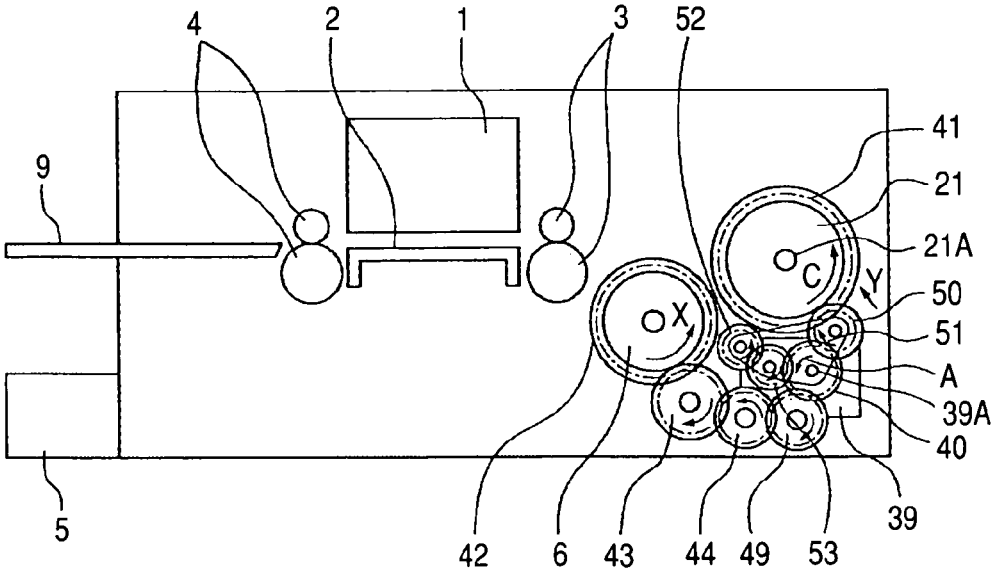
FIG. 2 is a sectional view of a driving portion of the recording apparatus according to Embodiment 1 of the present invention.
Figure 3:
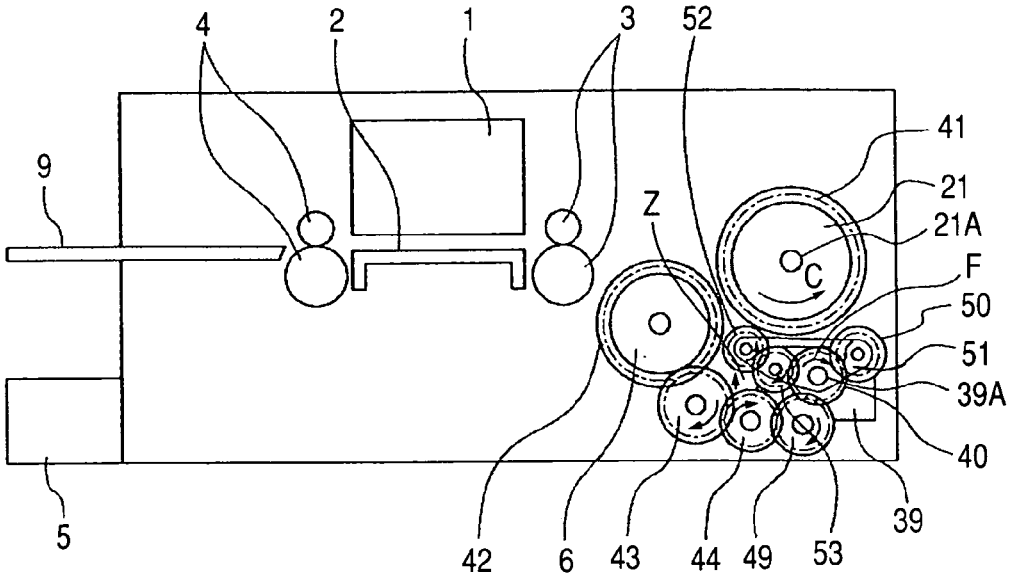
FIG. 3 is a sectional view of the driving portion of the recording apparatus according to Embodiment 1 of the present invention.
Figure 4:
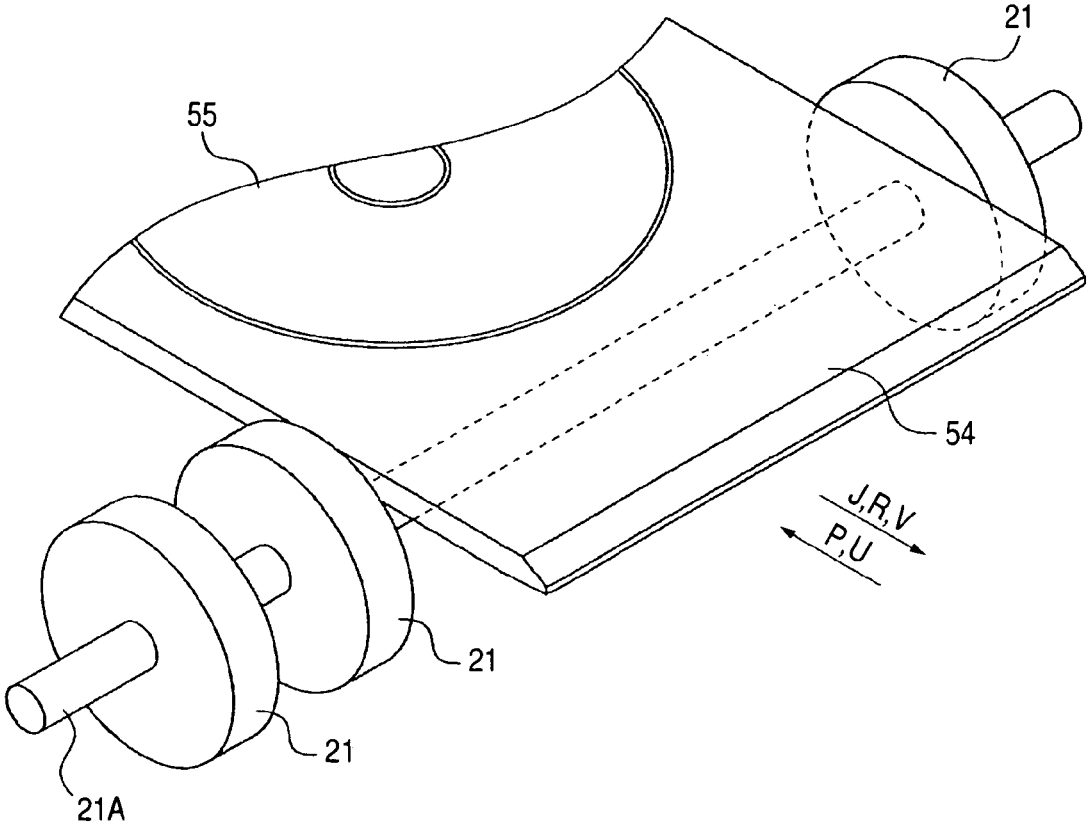
FIG. 4 is a perspective view of the recording apparatus according to Embodiment 1 of the present invention.

Embodiment 1 of the present invention will be described with reference to FIGS. 1 through 4. FIG. 1 is a main body sectional view showing Embodiment 1, FIGS. 2 and 3 are main body sectional views showing a drive construction, and FIG. 4 is a perspective view showing how a thick recording medium, such as a CD or DVD, is transported.

In FIG. 1, reference numeral 1 indicates a recording head that discharges ink selectively from a plurality of discharge ports to perform recording. The recording head 1 is retained in position by a carriage (not shown), and reciprocates in a direction perpendicular to the recording medium transporting direction to perform printing on a recording medium. Reference numeral 2 indicates a platen opposed to the recording head 1 and retains the recording medium at a printing portion.

Next, a U-turn sheet feeding structure will be described.

Reference numeral 5 indicates a sheet feeding cassette retaining recording mediums in a stacked state, reference numeral 6 indicates a U-turn sheet feeding roller for separately transporting the recording mediums, reference numeral 23 indicates a paper guide for guiding the outer side of the recording medium at the time of U-turn sheet feeding and at the time of duplex transport, reference numeral 21 indicates a U-turn transport roller for transporting the recording medium at the time of U-turn sheet feeding and at the time of duplex transport, reference numeral 25 indicates a U-turn transport roller adapted to be driven to rotate while pressurizing the U-turn transport roller 21, reference numeral 3 indicates a main transport roller pair for transporting the recording medium to the printing portion, reference numeral 26 indicates a paper guide for guiding the recording medium to the main transport roller pair 3, reference numeral 4 indicates an ejection roller pair for ejecting the recording medium, and reference numeral 9 indicates an ejection tray for retaining the ejected recording medium. Reference numeral 24 indicates a paper guide flapper weakly urged in the direction of the arrow K, using a portion 24B as the rotation center, to abut the paper guide 26. The paper guide flapper 24 guides the inner side of the recording medium at the time of U-turn sheet feeding and at the time of duplex transport.

Next, a U-turn sheet feeding operation will be described.

The recording mediums stacked in the sheet feeding cassette 5 are separately transported in the direction of the arrow M by the U-turn sheet transport roller 6, further transported in the direction of the arrow by the U-turn transport roller 21 and U-turn transport rollers 25, and transported in the direction of the arrow I while guided by the paper guide 26 and the paper guide flapper 24. At this time, the recording medium is urged with low pressure toward the paper guide flapper 24 and the paper guide 26, so that it can pass between the paper guide 26 and the paper guide flapper 24. The recording medium is further transported in the direction of the arrow P to the printing portion by the main transport roller pair 3, and printing is performed thereon by the recording head 1; the recording medium is then transported in the direction of the arrow U by the ejection roller pair 4, and ejected onto the ejection tray 9.

Next, a two-side printing structure will be described.

Reference numerals 22 and 27 indicate paper guides for guiding the outer side of the recording medium at the time of duplex transport. The paper guide flapper 24 has a guide portion 24A for guiding the inner side of the recording medium at the time of duplex transport.

Next, a two-side printing operation will be described.

The recording medium fed by the U-turn sheet feeding mechanism undergoes printing by the recording head 1; when the printing on the obverse side is completed, the main transport roller pair 3 and the ejection roller pair 4 are reversed in rotation to transport the recording medium in the direction of the arrow R. The recording medium is further transported in the direction of the arrow S by the main transport roller pair 3, and transported to a duplex transport portion. At this time, the recording medium is transported while guided by the paper guide portion 24A of the paper guide flapper 24 and the paper guide 27.

Further, while guided by the paper guide 27, the recording medium is transported in the direction of the arrow H, effecting joining with the U-turn sheet feeding transport path. The transport from this onward is the same as that at the time of U-turn sheet feeding, the recording medium being transported in the directions of the arrows N and I. In a reversed state, the recording medium is transported again in the direction of the arrow P toward the main transport roller pair 3. Printing is performed on the reverse side of the reversed recording medium by the recording head 1; after the completion of the printing, the recording medium is ejected onto the ejection tray 9, thus completing the two-side printing.

Next, the construction of a horizontal path for performing printing on a thick printing medium, such as a CD or a DVD, will be described with reference to FIGS. 1 through 4.

The paper guide 23 for guiding the outer side of the recording medium at the time of U-turn sheet feeding and at the time of duplex transport is equipped with a guide hole 23B for guiding the recording medium in the horizontal path.

The paper guide portion 24A of the paper guide flapper 24 is arranged outside the region where a thick recording medium is transported in the horizontal path. In the horizontal path, the thick recording medium is transported while guided by the paper guide 24. Further, as shown in FIG. 4, when transported, a thick recording medium 55, such as a CD or a DVD, is set in position on a transport tray 54. The U-turn transport roller 21 is composed of a roller shaft 21A and rubber portions separately arranged thereon, with the rubber portions being arranged outside the region where the thick recording medium is transported in the horizontal path. Due to this construction, the transport tray 54 can overlap the U-turn transport roller 21 during transport.

Next, the transport operation in the horizontal path will be described.

In FIG. 1, the transport tray 54 with the recording medium 55 consisting of a CD, DVD or the like placed thereon is inserted from the ejection side in the direction of the arrow J, and transported in the direction of the arrow R by reverse operation of the ejection roller pair 4 and the main transport roller pair 3. Further, the transport tray is transported in the direction of the arrow V while guided by the paper guides 26, 27 and the paper guide flapper 24 to reach the guide hole 23B of the paper guide 23. Next, the main transport roller pair 3 and the ejection roller pair 4 are caused to make normal rotation to transport the transport tray 54 in the direction of the arrow P. At this time, recording head 1 performs printing on the recording medium 55, such as a CD or a DVD, placed on the transport tray 54; after the completion of the printing, the transport tray is ejected in the direction of the arrow U, thus completing the printing in the horizontal path.

Next, a construction for an anti-jam processing to be performed when jamming has occurred due to a transport error during U-turn sheet feeding, duplex transport, or horizontal path transport will be described.

In FIG. 1, the paper guide 23 for guiding the outer side of the recording medium at the time of U-turn sheet feeding and at the time of duplex transport can be opened and closed using a rotation shaft 23A as the rotation center. When performing anti-jam processing, the paper guide 23 is opened in the direction of the arrow W, whereby it is possible to remove the jammed recording medium.

Next, the drive construction of the U-turn sheet feeding roller 6 and the U-turn transport roller 21 will be described with reference to FIGS. 2 and 3.

Reference numeral 41 indicates a U-turn transport roller gear provided on the shaft of the U-turn transport roller 21, reference numeral 42 indicates a U-turn sheet feeding roller gear provided on the shaft of the U-turn sheet feeding roller 6 and having a one-way clutch mechanism (not shown) transmitting driving force solely in the sheet feeding direction, reference numeral 39 indicates a drive motor, reference numeral 40 indicates a motor gear arranged on a motor shaft 39A of the drive motor 39, reference numerals 50, 52, and 53 indicate pendulum idler gears on which positioning is effected with a pendulum gear holder 51 using the motor gear 40 as the rotation center, and reference numerals 43, 44, and 49 indicated U-turn sheet feeding idler gears for transmitting driving force from the motor gear 40 to the U-turn sheet feeding roller gear 42.

Next, a separating operation in U-turn sheet feeding will be described with reference to FIG. 2.

When the motor gear 40 rotates in the normal direction, i.e., in the direction of the arrow A, the pendulum gear holder 51 swings in the direction of the arrow Y. Then, the pendulum idler gear 50 is brought into mesh with the U-turn transport roller gear 41, and the U-turn transport roller 21 rotates in the direction of the arrow C.

At this time, the pendulum idler gear 52 is separated from the U-turn transport roller gear 41 by the swinging in the direction of the arrow Y of the pendulum gear holder 51, and no driving force is transmitted. At the same time, driving force is transmitted to the U-turn sheet feeding roller gear 42 through the U-turn sheet feeding idler gears 43, 44, and 49, and the U-turn sheet feeding roller 6 rotates in the direction of the arrow X, the recording medium being separated to be fed. When the recording medium is fed and reaches the nip portion between the U-turn transport roller 21 and the U-turn transport roller 25, the sheet feeding operation is completed (FIG. 1).

Next, a transport operation in U-turn sheet feeding will be described with reference to FIG. 3.

When the sheet feeding operation is completed, the motor gear 40 is reversed to rotate in the direction of the arrow F; then, the pendulum gear holder 51 swings in the direction of the arrow Z, and the pendulum idler gear 52 is meshed with the U-turn transport roller gear 41, the U-turn transport roller 21 rotating in the direction of the arrow C as in the case of sheet feeding.

At this time, the pendulum idler gear 50 is separated from the U-turn transport roller gear 41 by the swinging in the Z-direction of the pendulum gear holder 51, and no driving force is transmitted. On the other hand, driving force is transmitted to the U-turn sheet feeding roller gear 42 through the U-turn sheet feeding idler gears 43, 44, and 49;

however, due to the above-described one-way clutch mechanism, the driving of the U-turn sheet feeding roller gear 42 is not transmitted to the U-turn sheet feeding roller 6, and the U-turn sheet feeding roller 6 is brought to a stop.

Next, a two-side printing operation will be described with reference to FIG. 3.

When the motor gear 40 is reversed to rotate in the direction of the arrow F, the U-turn transport roller 21 rotates in the direction of the arrow C. By the rotation of the U-turn transport roller 21 in the direction of the arrow C, transport for two-side printing is conducted. At this time, the U-turn sheet feeding roller 6 is at rest due to the above-described drive construction, and no sheet feeding operation is conducted. Otherwise, the operation is the same as the above-described transport operation for two-side printing, so that a description thereof will be omitted.

As described above, commonality is achieved between the transport path for U-turn sheet feeding and the transport path for two-side printing, as well as overlapping with the horizontal path, whereby it is possible to realize a reduction in size and cost.

[Embodiment 2]

In Embodiment 1 described above, the recording medium transport direction in U-turn sheet feeding and the recording medium transport direction in two-side printing are the same. In Embodiment 2, the recording medium transport direction in U-turn sheet feeding and the recording medium transport direction in two-side printing are opposite to each other.

Figure 5:
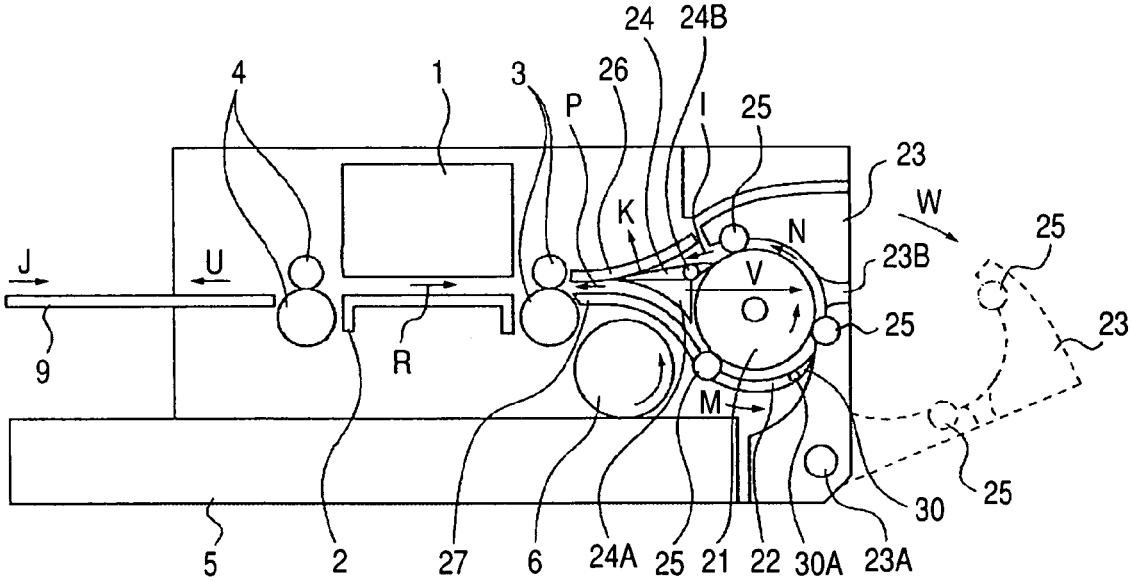
FIG. 5 is a sectional view of the main body of a recording apparatus according to Embodiment 2 of the present invention.

A U-turn sheet feeding operation will be described with reference to FIG. 5.

This embodiment differs from Embodiment 1 in that a paper guide flapper 30 is added to the forward end of the paper guide 22. The paper guide flapper 30 has a rotation center 30A, around which it is weakly urged toward the paper guide 23. Since the paper guide flapper 30 is urged with a low pressure, the recording medium can pass between the paper guide 23 and the paper guide flapper 30. The recording medium fed by the U-turn sheet feeding roller 6 is transported in the direction of the arrow M, and is transported in the direction of the arrow while guided by the paper guide 23 and the paper guide flapper 30. The operation from this onward is the same as that in Embodiment 1, so that a description thereof will be omitted. The construction of the horizontal path for performing printing on a thick recording medium, such as a CD or a DVD, is the same that of Embodiment 1, so that a description thereof will be omitted.

Figure 6:
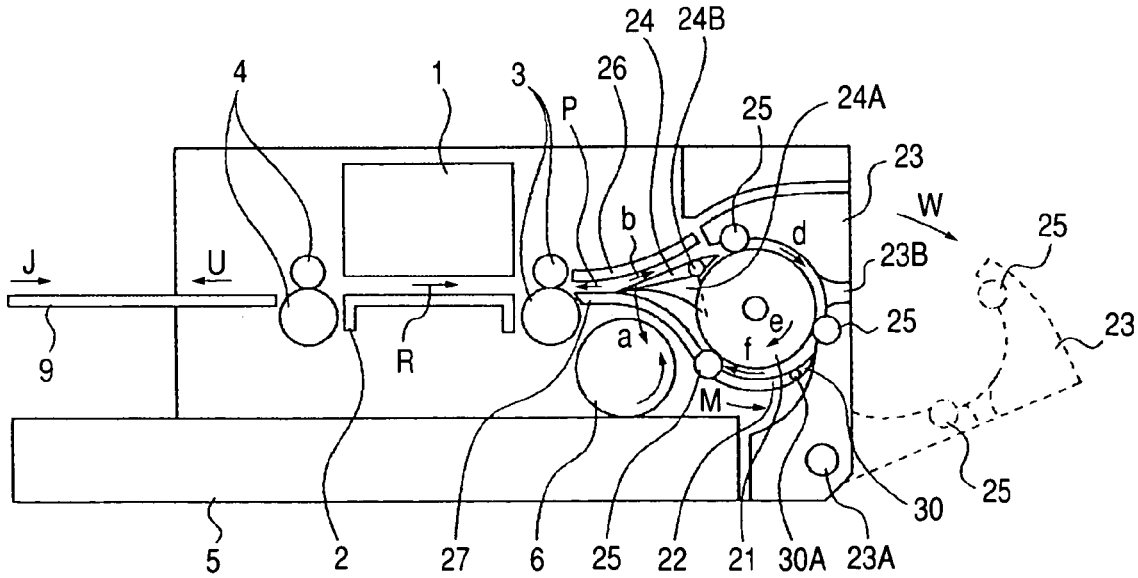
FIG. 6 is a sectional view of the main body of the recording apparatus according to Embodiment 2 of the present invention.

Next, a two-side printing structure will be described with reference to FIG. 6.

The operation from the U-turn sheet feeding to the surface printing operation is the same as that in Embodiment 1, so that a description thereof will be omitted. When the surface printing is completed, the main transport roller pair 3 and the ejection roller pair 4 are reversed in rotation, and the recording medium is transported in the direction of the arrow R. The recording medium is further transported in the direction of the arrow b by the main transport roller pair 3, and is transported to the duplex transport portion. At this time, the paper guide flapper 24 moves in the direction of the arrow a, thus securing the transport path.

Further, conversely to U-turn sheet feeding, the U-turn sheet transport roller 21 rotates in the direction of the arrow e. As a result, the recording medium is transported in the directions of the arrows d and f while guided by the paper guide 26, the paper guide flapper 24, the paper guide 23, and the paper guide flapper 30. Further, the recording medium is transported in the direction of the arrow P while guided by the abutment portion of the paper guide 27 and the paper guide flapper 24, whereby the recording medium reversing operation is completed. At this time, the paper guide flapper 24 abuts the paper guide 27 with a low pressure, so that the recording medium is allowed to pass. The transport operation from this onward is the same as that in Embodiment 1, so that a description thereof will be omitted.

[Embodiment 3]

In Embodiment 1, the U-turn sheet feeding mechanism is arranged at a position separate from the transport path for two-side printing. In Embodiment 3, the U-turn sheet feeding mechanism is formed in the transport path for two-side printing, thereby achieving a further reduction in size.

Figure 7:
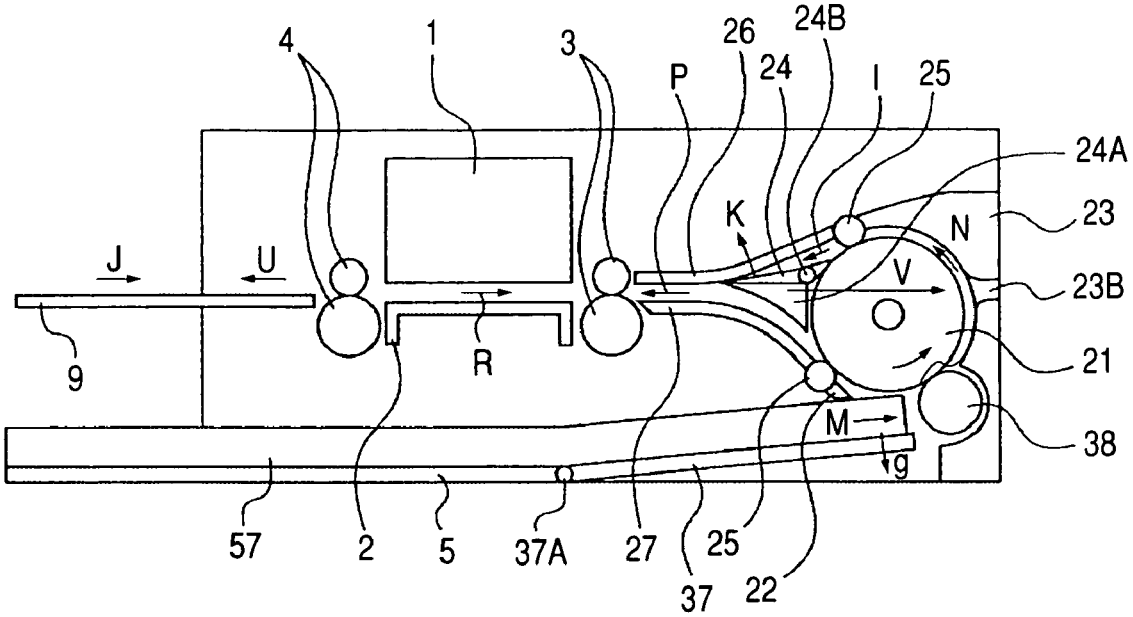
FIG. 7 is a sectional view of the main body of a recording apparatus according to Embodiment 3 of the present invention.

A U-turn sheet feeding operation will be described with reference to FIG. 7.

This embodiment differs from Embodiment 1 in that the U-turn sheet feeding roller 6 is eliminated and that there is added a separation roller 38 adapted to abut the U-turn transport roller 21 to separate the recording medium. In this construction, the U-turn transport roller 21 also serves as the sheet feeding roller. Further, there is provided a middle plate 37 for bringing the recording medium P into press contact with the U-turn transport roller 21. Through rotation of the U-turn transport roller 21, the recording medium P is transported in the direction of the arrow M. Then, the recording medium is separated at the nip portion between the U-turn transport roller 21 and the separation roller 38 and is transported in the direction of the arrow N. When the separation of the recording medium is completed, the middle plate 37 retracts in the direction of the arrow g, and moves to a position where the next sheet feeding is not conducted. The transport operation from this onward is the same as that in Embodiment 1, so that a description thereof will be omitted.

The construction of the horizontal path for performing printing on a thick recording medium, such as a CD or a DVD, is the same that of Embodiment 1, so that a description thereof will be omitted.

Figure 8:
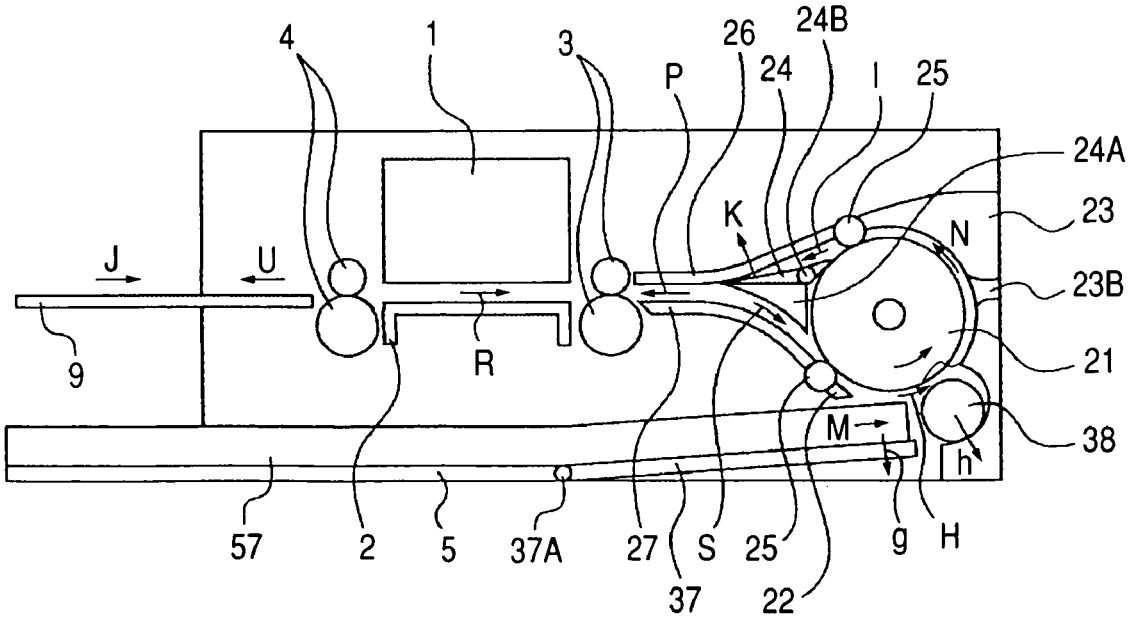
FIG. 8 is a sectional view of the main body of the recording apparatus according to Embodiment 3 of the present invention.

Next, a two-side printing structure will be described with reference to FIG. 8.

The operation from the U-turn sheet feeding to the surface printing operation is the same as that in Embodiment 1, so that a description thereof will be omitted. When the surface printing is completed, the main transport roller pair 3 and the ejection roller pair 4 are reversed in rotation, and the recording medium is transported in the direction of the arrow R. The recording medium is further transported in the direction of the arrow S by the main transport roller pair 3, and is transported to the duplex transport portion. At this time, the recording medium is transported while guided by the paper guide 24A of the paper guide flapper 24 and the paper guide 27. Further, the recording medium is transported in the direction of the arrow H while guided by the paper guides 27 and 22, and meets the U-turn sheet feeding transport path. At this time, the middle plate 37 retracts in the direction of the arrow g, and the separation roller 38 also retracts in the direction of the arrow h, thus securing the transport path. The transport operation from this onward is the same as that in the U-turn sheet feeding operation, so that a description thereof will be omitted.

[Embodiment 4]

In Embodiment 1, there is provided a single U-turn transport roller for transporting the recording medium at the time of U-turn sheet feeding and at the time of duplex transport. In Embodiment 4, two U-turn transport rollers are provided. By providing two U-turn transport rollers, it is possible to avoid overlapping of the horizontal path and the transport roller, and, in addition to the thick recording medium, such as a CD or a DVD, a thick paper sheet of A4 width can also be transported in the horizontal path.

Figure 9:
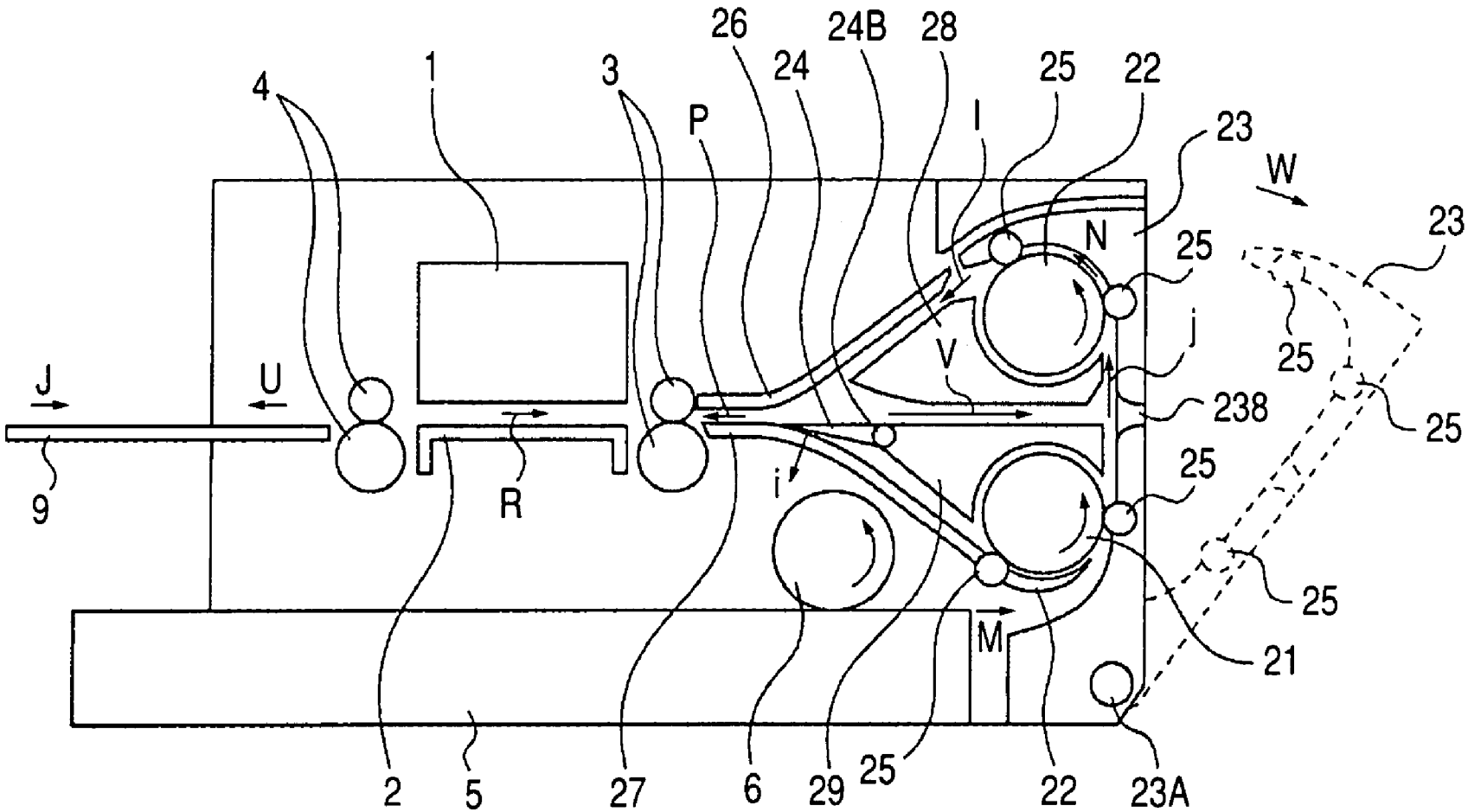
FIG. 9 is a sectional view of the main body of a recording apparatus according to Embodiment 4 of the present invention.

A U-turn sheet feeding operation will be described with reference to FIG. 9.

This embodiment differs from Embodiment 1 in that there are added a second U-turn transport roller 22 and paper guides 28 and 29. Further, the position of the paper guide flapper 24 is changed. The recording medium fed by the U-turn sheet feeding roller 6 is transported in the direction of the arrow M, and transported in the direction of the arrow j while guided by the paper guides 22, 23, 28, and 29, and is further transported in the directions of the arrows N, I, and P by the second U-turn transport roller 22. At this time, the paper guide flapper 24 moves in the direction of the arrow i to secure the transport path. The transport operation from this onward is the same as that in Embodiment 1, so that a description thereof will be omitted.

Next, the construction of the horizontal path for performing printing on a thick recording medium, such as a CD or a DVD, will be described.

The paper guide 23 for guiding the outer side of the recording medium during U-turn sheet feeding and duplex transport is equipped with the guide hole 23B for guiding the recording medium in the horizontal path.

The paper guide flapper 24 moves in the direction of the arrow i to secure the transport path of the horizontal path. In the horizontal path, the recording medium is guided by the paper guides 26 and 27, the paper guide flapper 24, the paper guides 28 and 29, and the guide hole 23B of the paper guide 23. While in Embodiment 1 the recording medium transport path in the horizontal path and the U-turn transport roller 21 overlap each other, by arranging two transport rollers (21 and 22), there is no overlapping of the recording medium transport path in the horizontal path and the U-turn transport rollers 21 and 22, so that, in addition to a CD, a DVD, or the like, a thick paper sheet of A4 width can also be transported. Otherwise, the construction of the horizontal path is the same as that of Embodiment 1, so that a description thereof will be omitted.

Figure 10:
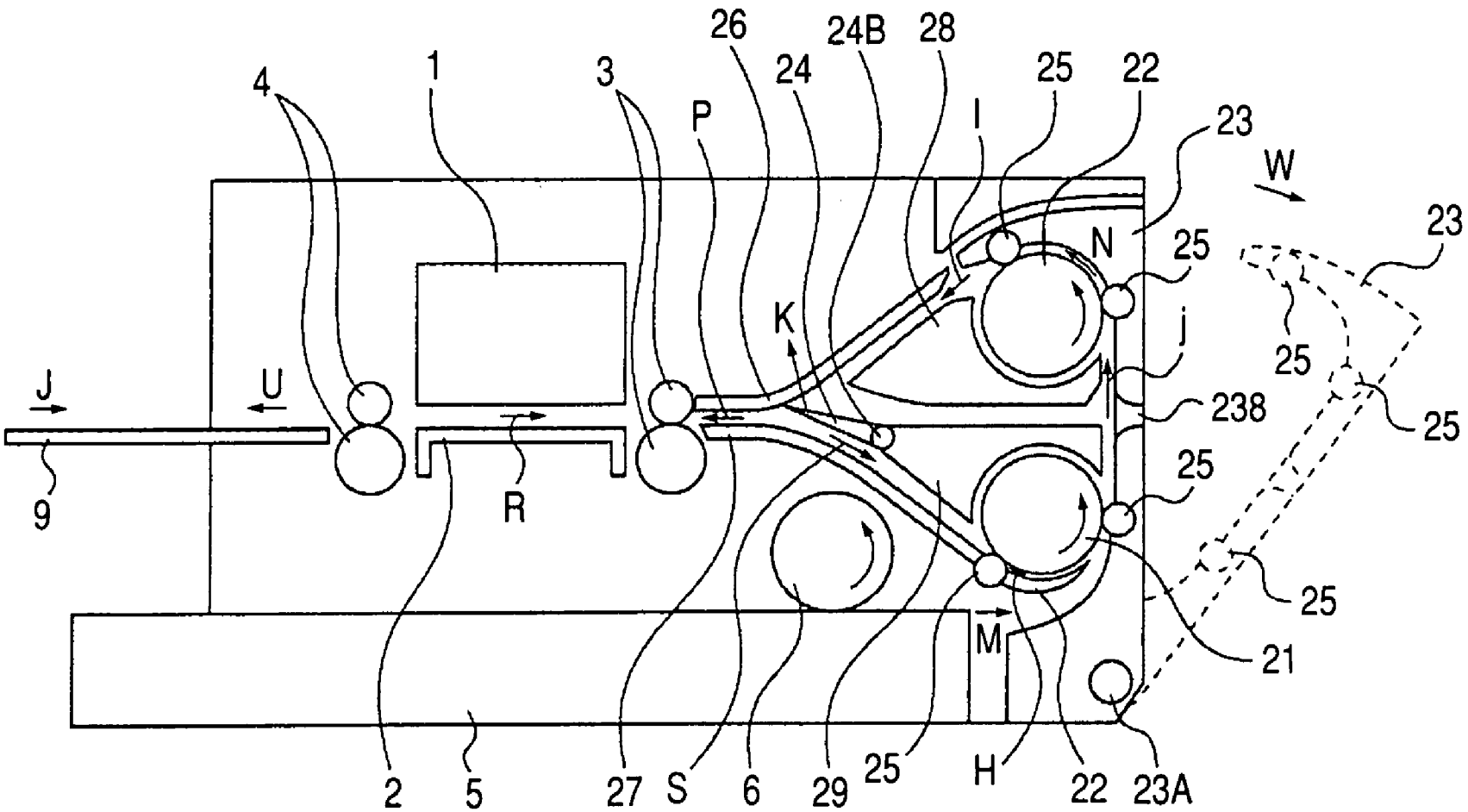
FIG. 10 is a sectional view of the main body of the recording apparatus according to Embodiment 4 of the present invention.

Next, a two-side printing operation will be described with reference to FIG. 10.

The operation from the U-turn sheet feeding to the surface printing is the same as that in Embodiment 1, so that a description thereof will be omitted. When the surface printing is completed, the main transport roller pair 3 and the ejection roller pair 4 are reversed in rotation to transport the recording medium in the direction of the arrow R. The recording medium is further transported in the direction of the arrow S by the main transport roller pair 3, and is transported to the duplex transport portion. At this time, the paper guide flapper 24 moves in the direction of the arrow K to secure the transport path. Further, the recording medium is transported in the directions of the arrows H, j, and N while guided by the paper guide 27, the paper guide flapper 24, and the paper guides 22, 23, 28, and 29. The transport operation from this onward is the same as that of Embodiment 1, so that a description thereof will be omitted.

[Embodiment 5]

In Embodiment 2 described above, a single U-turn transport roller is provided, and the recording medium transport direction in U-turn sheet feeding and the recording medium transport direction in two-side printing are opposite to each other. In Embodiment 5, two U-turn transport rollers are provided, and the recording medium transport direction in U-turn sheet feeding and the recording medium transport direction in two-side printing are opposite to each other.

Figure 11:
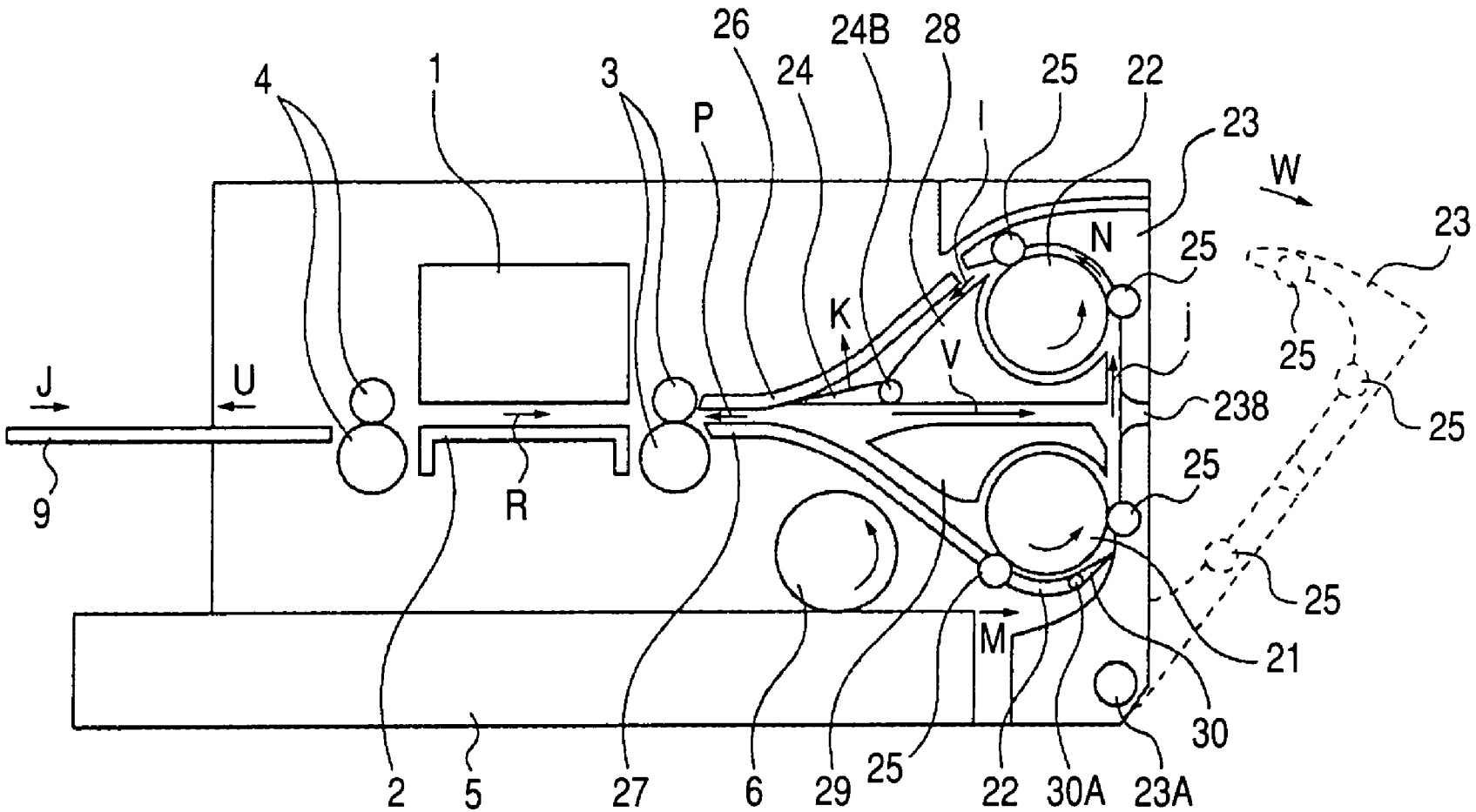
FIG. 11 is a sectional view of the main body of a recording apparatus according to Embodiment 5 of the present invention.

A U-turn sheet feeding operation and a recording medium transport operation in the horizontal path will be described with reference to FIG. 11.

This embodiment is the same as Embodiment 4 in that two U-turn transport rollers (21 and 22) are provided, and the same as Embodiment 2 in that the recording medium transport direction in U-turn sheet feeding and the recording medium transport direction in two-side printing are opposite to each other, so that a description of these features will be omitted.

Figure 12:
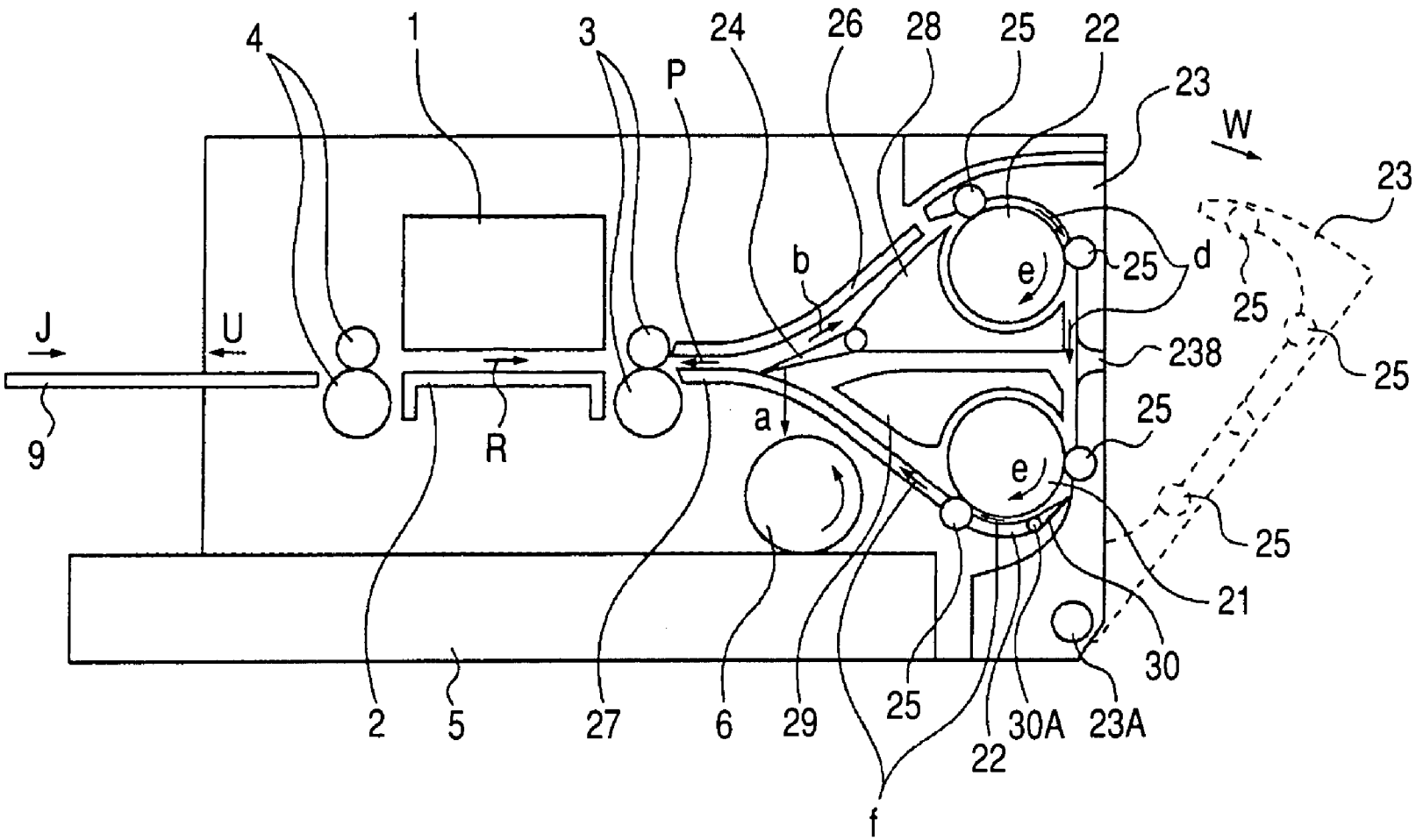
FIG. 12 is a sectional view of the main body of the recording apparatus according to Embodiment 5 of the present invention.

Next, a two-side printing operation will be described with reference to FIG. 12.

This embodiment is the same as Embodiment 4 in that two U-turn transport rollers (21 and 22) are provided, and the same as Embodiment 2 in that the recording medium transport direction in U-turn sheet feeding and the recording medium transport direction in two-side printing are opposite to each other, so that a description of these features will be omitted.

[Embodiment 6]

In Embodiment 2 described above, a pendulum gear is used for driving force transmission from the drive motor 39 to the U-turn transport roller 21. In Embodiment 6, a one-way clutch is used instead of the pendulum gear. Embodiment 6 will be described with reference to FIGS. 13 and 14.

This embodiment differs from Embodiment 1 in that there are two driving paths from the motor gear 40 to the U-turn transport roller gear 41. One path connects the motor gear 40 to the U-turn transport roller gear 41 by way of idler gears 45 and 47. The other path connects the motor gear 40 to the U-turn transport roller gear 41 by way of an idler gear 46. The idler gear 47 is formed by a double gear and has a speed reduction mechanism. This makes it possible to reduce the transport speed as compared with that in the other driving path. Further, it is also possible for the double gear of the idler gear 47 to have a speed increasing mechanism, making it possible to increase the transport speed as compared with that in the other driving path.

Figure 13:
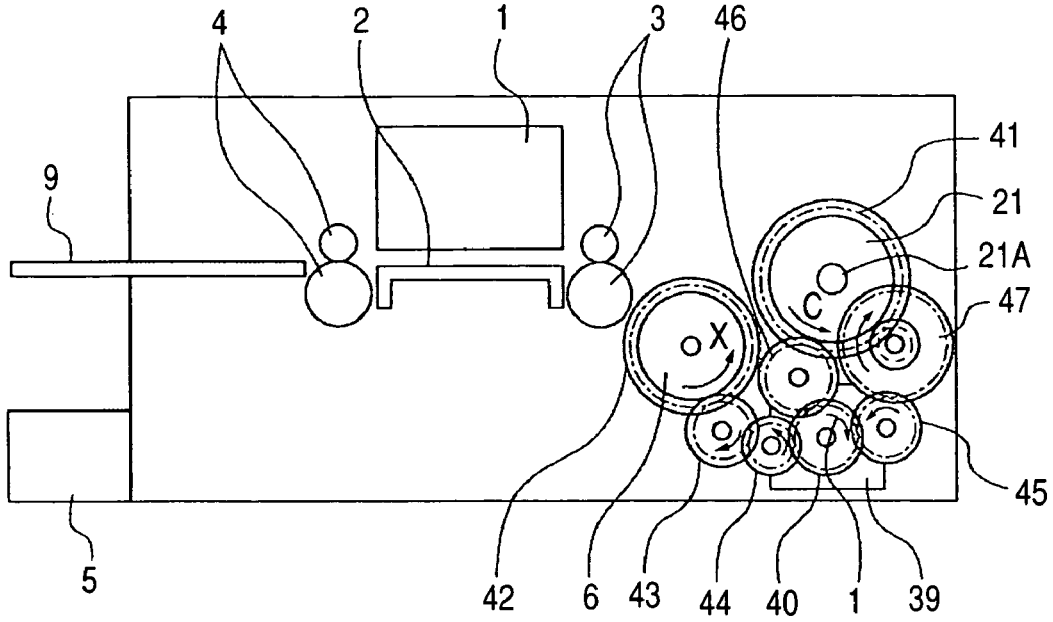
FIG. 13 is a sectional view of a driving portion of a recording apparatus according to Embodiment 6 of the present invention.

Further, the idler gear 45 or 47 is provided with a one-way clutch mechanism (not shown) for transmitting driving force solely in the direction of the arrow in FIG. 13. Similarly, the idler gear 46 is also provided with a one-way clutch mechanism (not shown) for transmitting driving force solely in the direction of the arrow in FIG. 14. From the motor gear 40 to the U-turn sheet feeding roller gear 42, driving connection is effected by idler gears 43 and 44.

Next, a U-turn sheet feeding operation will be described with reference to FIG. 13.

When the motor gear 40 is driven in the normal direction to rotate in the direction of the arrow 1, the idler gears 45 and 47 rotate in the directions of the arrows, and driving force is transmitted to the U-turn transport roller gear 41, causing the U-turn transport roller 21 to rotate in the direction of the arrow C. In this process, due to the one-way clutch mechanism formed in the idler gear 46, no driving force is transmitted to one driving path to the U-turn transport roller gear 41. On the other hand, driving force is transmitted from the U-turn sheet feeding roller gear 42 through the idler gears 43 and 44, and the recording medium is separated and fed. When the recording medium is fed, and reaches the nip portion between the U-turn transport roller 21 and the U-turn transport roller 25, the sheet feeding operation is completed (FIG. 1).

Figure 14:
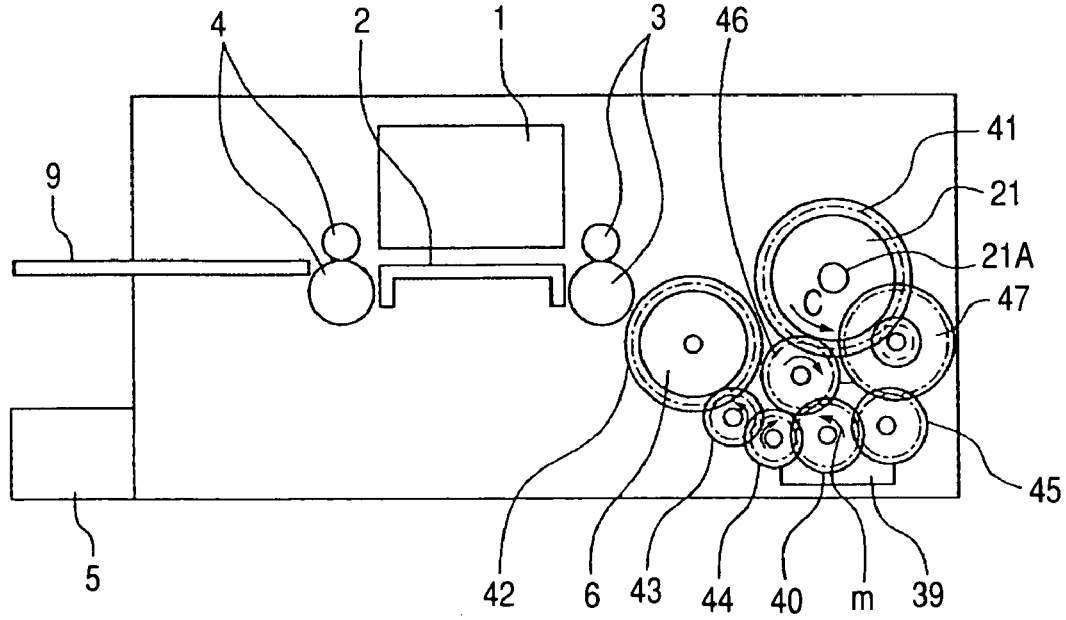
FIG. 14 is a sectional view of a driving portion of the recording apparatus according to Embodiment 6 of the present invention.

Next, a transport operation in U-turn sheet feeding will be described with reference to FIG. 14.

When the sheet feeding operation is completed, the motor gear 40 is reversed to rotate in the direction of the arrow m; then, the idler gear 46 rotates in the direction of the arrow, transmitting driving force to the U-turn transport roller gear 41. As in the sheet feeding operation, this causes the U-turn transport roller 21 to rotate in the direction of the arrow C. At this time, due to the one-way clutch mechanism provided in the idler gear 45 or 47, no driving force is transmitted from the other driving path to the U-turn transport roller gear 41.

Further, while driving force is transmitted to the U-turn sheet feeding roller gear 42 through the U-turn sheet feeding idler gears 43 and 44, due to the one-way clutch mechanism, no driving force is transmitted from the U-turn sheet feeding roller gear 42 to the U-turn sheet feeding roller gear 6, which is brought to a stop.

Next, an operation in two-side printing will be described with reference to FIG. 14.

When the motor gear 40 is reversed to rotate in the direction of the arrow m, the U-turn transport roller 21 rotates in the direction of the arrow C. By the rotation of the U-turn transport roller 21 in the direction of the arrow C, the transport in two-side printing is effected. At this time, due to the above-described drive construction, the U-turn sheet feeding roller 6 is at rest, and no sheet feeding operation is conducted. Otherwise, this embodiment is the same as Embodiment 1, so that a further description thereof will be omitted.

[Embodiment 7]

In Embodiments 1 and 6 described above, the drive motor 39 is used to drive the U-turn transport roller 21. In Embodiment 7, driving force is transmitted to the U-turn transport roller 21 from the drive motor for driving the main transport roller pair 3 or the ejection roller pair 4. In this embodiment also, due to the pendulum gear or the one-way clutch mechanism, even if the main transport roller pair 3 or the ejection rollers 4 make normal and reverse rotation, the U-turn transport roller 21 rotates in one direction only.

[Embodiment 8]

Figure 15:
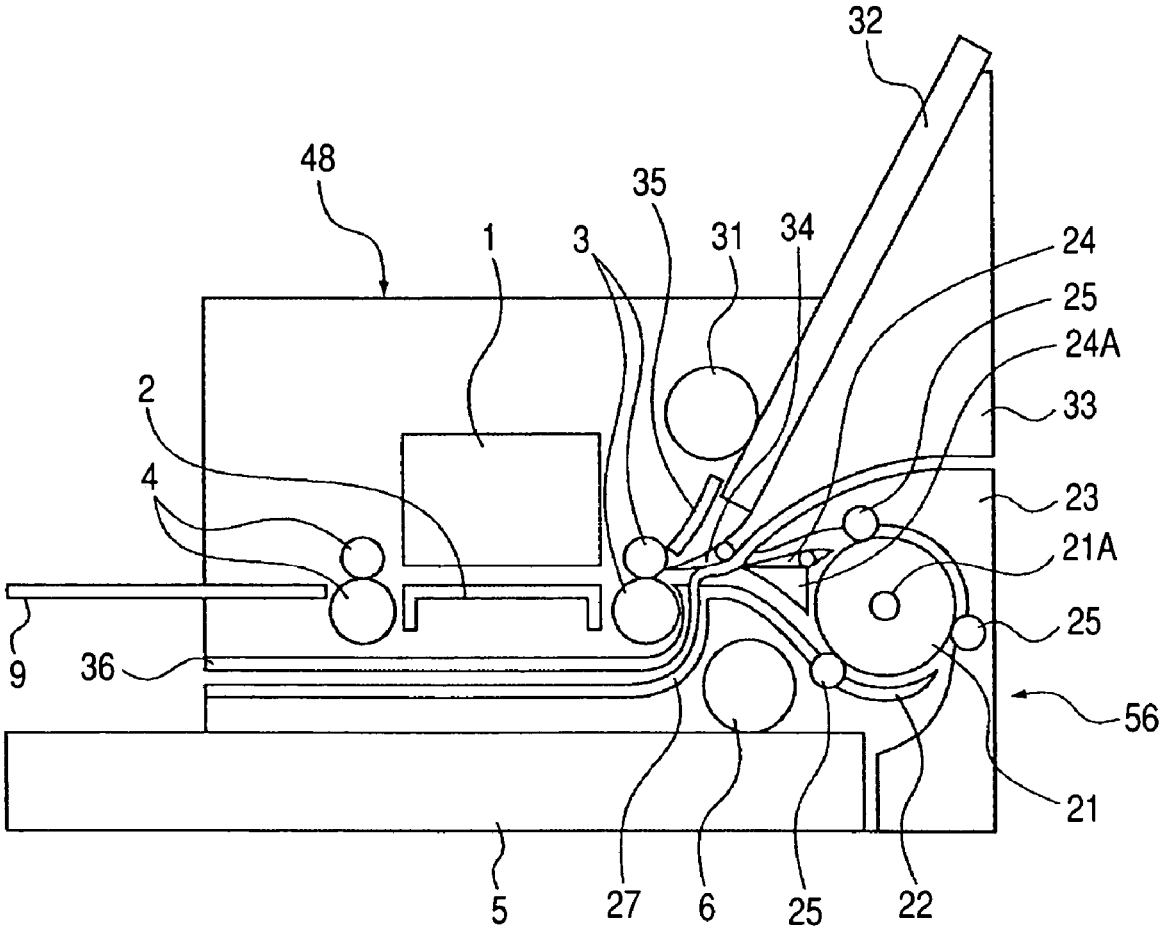
FIG. 15 is a sectional view of the main body of a recording apparatus according to Embodiment 8 of the present invention.

In Embodiment 1 described above, a construction in which a commonality is achieved between the U-turn sheet feeding transport path and the duplex transport path is incorporated into the apparatus main body. In Embodiment 8, the transport portion for U-turn sheet feeding and duplex transport is formed as a unit, which is detachably mountable to the apparatus main body. Embodiment 8 will be described with reference to FIG. 15.

An apparatus main body 48 is equipped with a mechanism for feeding sheets from above. Reference numeral 31 indicates a sheet feeding roller for separately feeding recording mediums, and reference numeral 32 indicates a stacking portion where recording mediums are stacked together. A recording medium fed by the sheet feeding roller 31 is transported to the main transport roller pair 3 while guided by a paper guide flapper 34 and a paper guide 35. The operations from printing on the recording medium to sheet ejection are the same as those in Embodiment 1, so that a description thereof will be omitted. A U-turn-sheet-feeding/duplex-transport unit 56 allows separation between a section formed by main body frames 36 and 33 of the apparatus main body 48 and a section formed by the paper guide portions 23 and 27 of the U-turn-sheet-feeding/duplex-transport unit 56. The construction of the transport portion is the same as that of Embodiment 1, so that a description thereof will be omitted.

In effecting the connection of the U-turn-sheet-feeding/duplex-transport unit 56 to the apparatus main body 48, positioning/fixing is effected by a positioning portion (not shown), and the mounting of the unit is detected by an electric detecting portion (not shown). When the mounting of the unit is detected, printer control is effected through control in correspondence with U-turn sheet feeding and two-side printing.

[Embodiment 9]

A standard recording apparatus according to this embodiment has a mechanism for feeding sheets from above the apparatus main body, functions to perform U-turn sheet feeding, duplex transport, and the transport of a thick recording medium, such as a CD or a DVD, and, further, a transport path allowing two-side printing on not only a cut paper sheet, such as an A4 size or letter size sheet but also a smaller size cut sheet such as an L-print size. Further, the recording apparatus of this embodiment has a transport path which allows, even in U-turn sheet feeding and two-side printing, not only the feeding of sheets from above but also the transport of a recording medium of high quality that does not easily bend.

Figure 16:
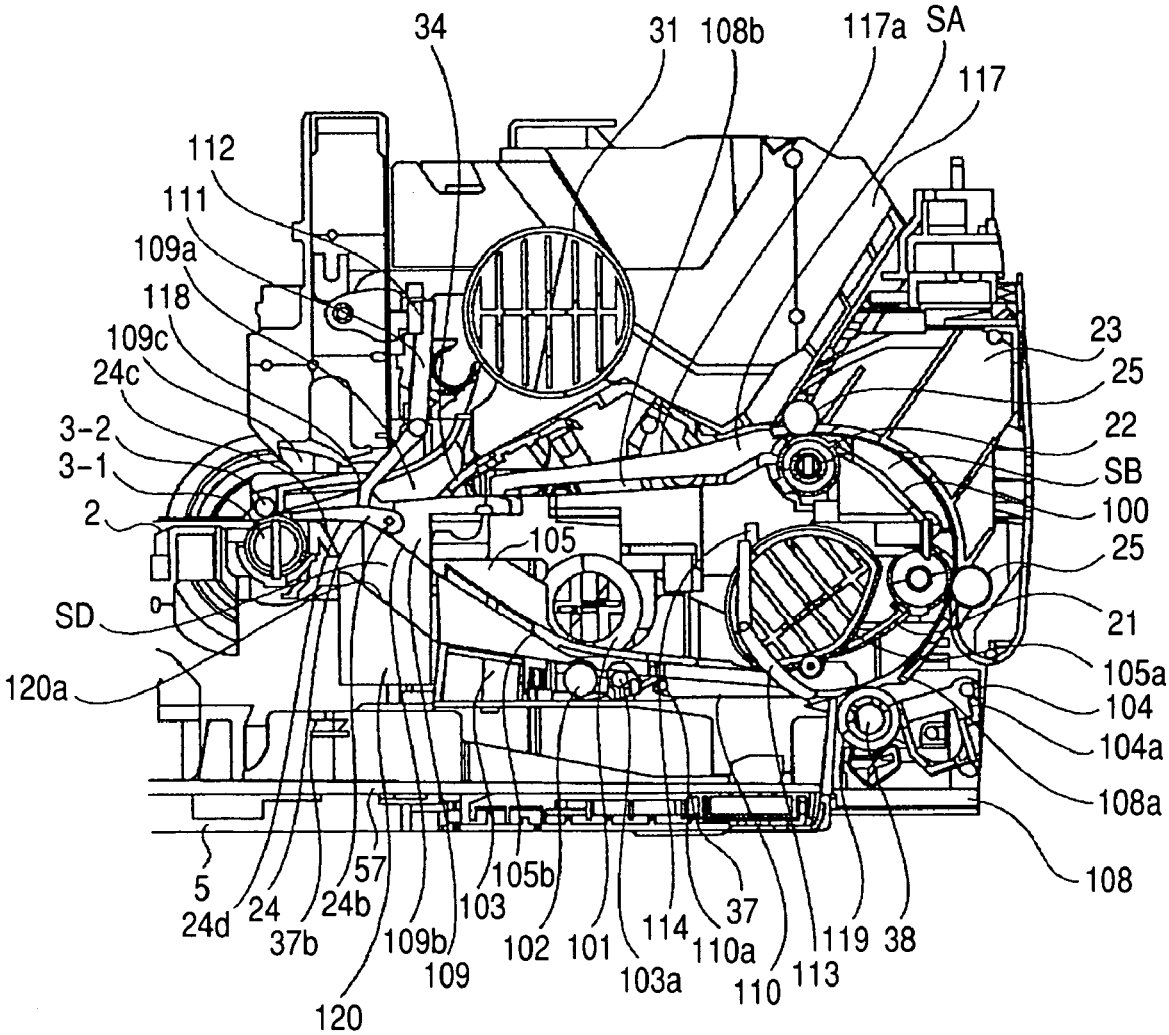
FIG. 16 is a sectional view of the main body of a recording apparatus according to Embodiment 9 of the present invention.

The transport path of the recording apparatus of Embodiment 9 will be described with reference to FIG. 16.

As in Embodiment 4, in this embodiment, there are provided two U-turn transport rollers (21 and 22). This makes it possible to secure the horizontal path for transporting a thick recording medium, such as a CD or a DVD, without involving an increase in the size of the main body, and to arrange the transport rollers at positions corresponding to various recording medium widths, such as A4, B5, A5, 2L-print, 4×6 size, postcard, envelope, and L-print size.

Reference numeral 101 indicates a duplex transport roller, which is rotatably set in position in a U-turn transport unit casing 108. A U-turn sheet feeding roller 6 has a semicircular configuration, and is arranged in the duplex transport path in order to achieve a reduction in the size of the main body. Further, a separation roller 38 in contact with the U-turn sheet feeding roller 6 and a holder 104 holding the separation roller 38 are arranged outside the transport path for U-turn sheet feeding and the transport path for duplex transport.

Reference numeral 111 indicates a first detection lever, and reference numeral 112 indicates a first detection sensor for detecting the operation of the first detection lever 111. The first detection lever 111 is arranged at a position where the transport paths for sheet feeding from above, U-turn sheet feeding, and duplex transport join, and detects the leading end and trailing end of a recording medium. Here, a thick recording medium, such as a CD or a DVD, is transported so as to be offset from the first detection lever 111 with respect to the width direction of the recording medium. This helps to prevent the thick recording medium, such as a CD or a DVD, and the first detection lever 111 from coming into contact with each other.

Reference numeral 113 indicates a second detection lever, and reference numeral 114 indicates a second detection sensor for detecting the operation of the second detection lever 113. The second detection lever 113 is arranged in the common transport path for U-turn sheet feeding and duplex transport and in the vicinity of a two-side flapper 110, and performs detection of the presence/absence and the trailing end of a recording medium during U-turn sheet feeding and detection of the leading end and trailing end of a recording medium during duplex transport. Further, it is also possible to perform detection as to whether or not a recording medium is sticking out of the sheet feeding cassette 5 to block the transport path for duplex transport. In order to prevent the second detection lever 113 from being abruptly caused to rotate by the ascent of the middle plate 37 to thereby generate noise during U-turn sheet feeding when the middle plate 37 is to be raised by a cam provided on the shaft of the U-turn sheet feeding roller 6, the second detection lever 113 is retracted upwards before the middle plate 37 and the recording medium P come into contact with each other, restoring the second detection lever 113 so that it may abut the recording medium P after the middle plate 37 has ascended. Due to this operation, it is possible to detect the presence/absence of a recording medium while preventing generation of noise.

As guide members on the outer side of the U-turn sheet feeding transport path, there are provided a guide portion 108*a* constituting a part of the casing 108 of the U-turn transport unit, a guide 23 also serving as an opening/closing portion for anti-jam processing, a lower surface portion 117*a* of an upper-side sheet feeding unit casing 117, an upper-side sheet feeding guide flapper 34, and a paper guide portion 118 supporting a pinch roller of the main transport roller pair 3 and rotatably supporting the first detection lever 111. Further, as guide members on the inner side of the U-turn sheet feeding transport path, there are provided a guide portion 105*a* constituting a part of an inner guide 105 of the duplex transport portion, a paper guide 106 arranged between two U-turn transport rollers 21 and 22, a guide portion 108*b* constituting a part of the U-turn transport unit casing 108, an upper guide portion 109*a* of a paper guide 109 downwardly swingable around the center axis of a main transport roller 3-1 of the main transport roller pair 3, and an upper guide portion 24*c* of a paper guide 24 rotatably mounted to the paper guide 109 at a center axis portion 24*b*. Here, a space SA above the guide portion 108*b* is a clearance portion for a loop when performing registration; it is a clearance portion for the S-shaped portion of a recording medium formed during registration by a recording medium bending force generated due to the fact that the nip portion of the main transport roller pair 3 is arranged so as to be offset downstream with respect to the transporting direction of the recording medium.

As the guide members on the outer side of the duplex transport path, there are provided a paper guide portion 109*c* constituting a part of a paper guide 109 downwardly swingable, a paper guide portion 120*a* constituting a part of a casing base 120 of the recording apparatus, an under paper guide 103 for anti-jam processing mounted so as to be rotatable around a rotation shaft 103*a* with respect to the U-turn transport unit casing 108 while rotatably supporting a two-side pinch roller 102 adapted to rotate with the duplex transport roller 101, and a two-side flapper 110 mounted to the U-turn transport unit casing 108 so as to be rotatable around a rotation shaft 110*a* and adapted to effect switching between the transport path for U-turn sheet feeding and the duplex transport path. Due to this construction, the downstream side transport path is the same as the above-described transport path for U-turn sheet feeding. Further, as the guide members on the inner side of the duplex transport path, there are provided a lower guide portion 24*d* of the rotatable paper guide 24, a lower guide portion 109*b* of the paper guide 109, and a guide portion 105*b* of the paper guide 105 rotatably supporting the second detection lever 113. Further, to reduce the resistance in the transport of a recording medium, the paper guide 105 is provided with a roller 119 which is rotatable.

Next, the transport path in this embodiment will be described.

In the U-turn transport portion, the outer guide has an arcuate configuration, whereas the inner guide 106 arranged between the two U-turn transport rollers 21 and 22 is formed so as to clear inwards. The clearance portion SB is of a configuration as required for the transport of a highly rigid recording medium by the two U-turn transport rollers. It functions as a clearance portion to be utilized when inward wrapping of the recording medium occurs due to a difference in transporting force between the two rollers or depending on the balance in transport resistance due to the guide portion. If a stationary paper guide portion is provided without securing the clearance portion SB, the following problem will be involved: when the trailing end of the recording medium leaves the first U-turn transport roller 21 on the upstream side, the recording medium, which has been bent by the two U-turn transport rollers, is restored to the original shape by its own rigidity, and gets caught between the paper guide 23 provided on the outer side and the stationary paper guide portion provided on the inner side, resulting in an increase in transport resistance. This leads to a deterioration in image quality.

Figure 17A:
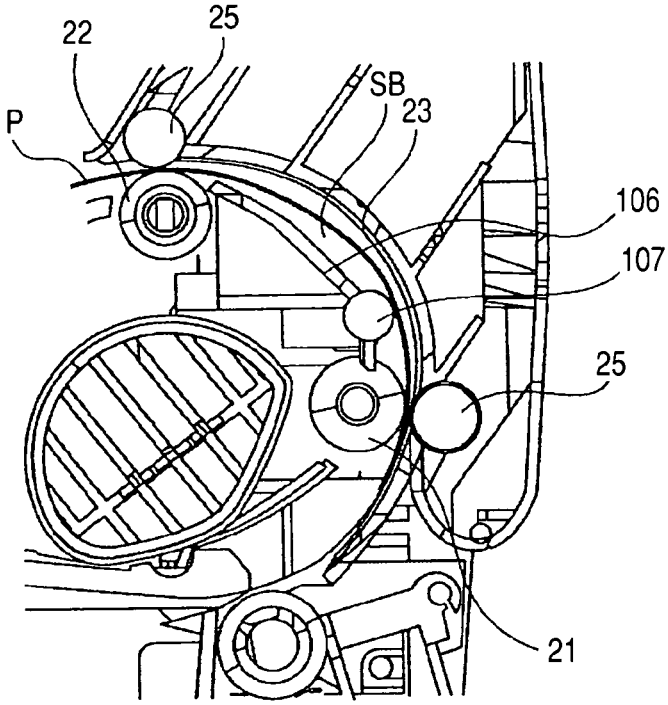
FIGS. 17A and 17B are sectional views of a U-turn transport portion.
Figure 17B:
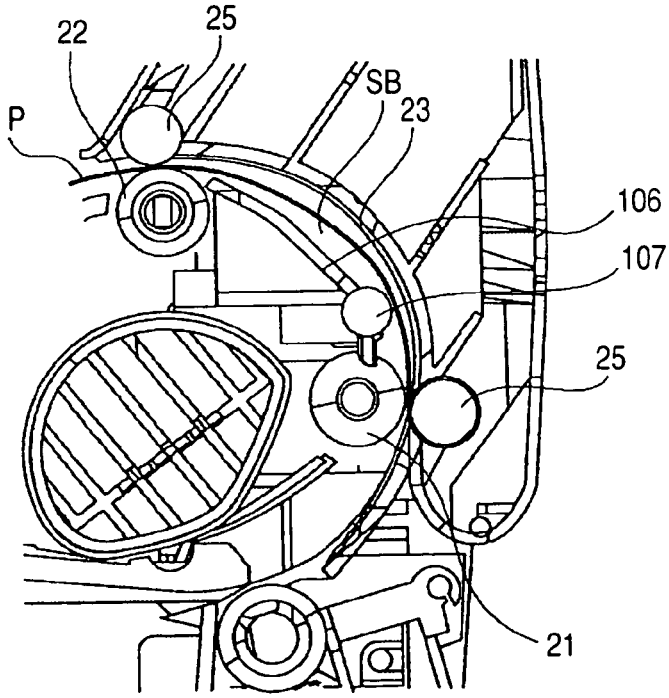

FIGS. 17A and 17B are sectional views of the U-turn transport portion. The inner guide 106 arranged between the two U-turn transport rollers 21 and 22 is provided with a driven roller 107. As shown in FIG. 17A, when the recording medium P is being transported while in contact with the upstream portion of the first U-turn transport roller 21 of the paper guide 23, the recording medium P is not in contact with the driven roller 107. As shown in FIG. 17B, when the trailing end of the recording medium P is detached from the upstream portion of the first U-turn transport roller 21 of the paper guide 23, and leaves the nip portion between the first U-turn transport roller 21 and the U-turn transport roller 25, the recording medium P comes into contact with the driven roller 107. This helps to restrain changes in the behavior of the recording medium P when it leaves the nip portion. Even after the trailing end of the recording medium P has left the nip portion, the recording medium P is transported while in contact with the driven roller 107. Here, in order to restrain changes in the behavior of the recording medium when it leaves the nip portion of the U-turn transport roller 21, and to prevent it from constituting a resistance to the transport of the recording medium afterwards, it is desirable for the driven roller 107 to be arranged downstream and in the vicinity of the first U-turn transport roller 21.

Figure 18:
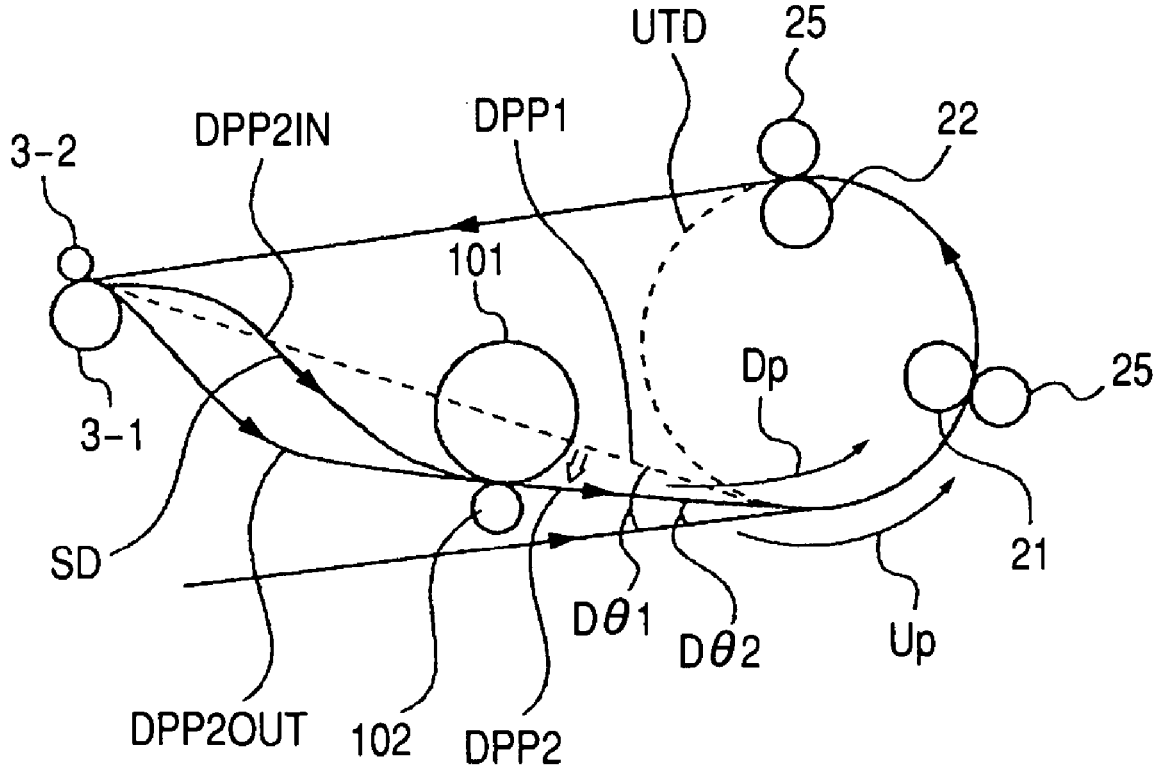
FIG. 18 is a schematic explanatory view of a duplex transport path and a U-turn sheet feeding transport path.

Next, to obtain in the duplex transport path an image equivalent to that in the U-turn sheet feeding transport path, it is necessary for the U-turn sheet feeding transport path and the duplex transport path to have the same transport resistance. FIG. 18 is a schematic explanatory view of the duplex transport path and the U-turn sheet feeding path. As shown in FIG. 18, to diminish the difference in the reaction force generated by the rigidity of the recording medium, it is necessary, as an imaginary circle UTD of the U-turn transport portion is approached, to at least expand outward by from a common tangent DPP1 to the main transport roller 3-1 and the imaginary circle UTD of the U-turn transport portion, which constitutes the shortest passage, bringing the U-turn transport path Up and the duplex transport path Dp close to each other (DPP2 to DPP2OUT). In other words, the angle made by Up and Dp is made Dθ2, which is smaller than Dθ1 (ideally, Dθ2=0 for the same transport path).

However, when the path: DPP2 to DPP2OUT is adopted, the transport resistance is rather large in the vicinity of the main transport roller 3-1. In view of this, a path configuration with a path buffer SD is adopted, in which at the position where recording medium P is conveyed to the duplex transport path by the main transport roller pair 3, a path DPP2IN is taken and in which after the trailing end of the recording medium has left the main transport roller pair 3, a path DPP2OUT is taken. That is, as shown in FIG. 16, the space SD between the inner guide and the outer guide of the duplex transport path is made sufficiently large. Then, due to the rigidity of the recording medium, when entering the duplex transport path, the path DPP2IN is taken, and, after the trailing end of the recording medium has left the main transport roller pair 3, the path DPP2OUT is taken. Further, to bring the U-turn transport path and the duplex transport resistance closer to each other, a duplex transport roller 101 is preferably provided between the main transport roller 3-1 and the first U-turn transport roller 21, thereby canceling the transport resistance generated on the upstream side of the duplex transport roller 101.

Figure 19:
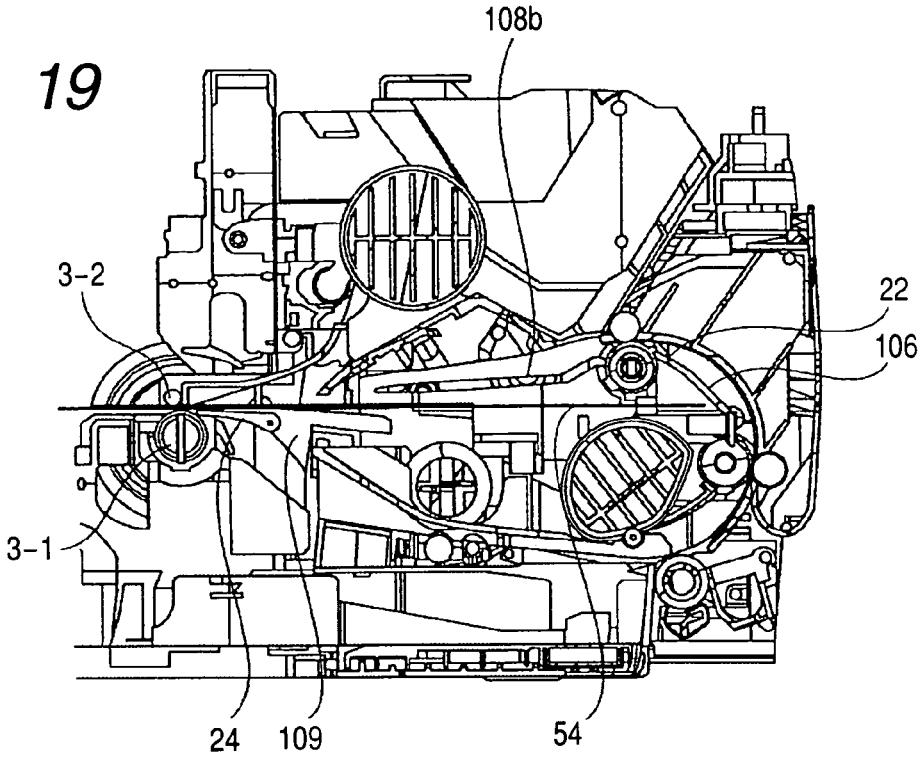
FIG. 19 is a sectional view showing how a thick recording medium, such as a CD or DVD, is transported.

FIG. 19 is a sectional view showing how a thick recording medium, such as a CD or a DVD, is transported. As shown in FIG. 19, with the paper guide flapper 24 lowered, the main transport roller 3-1 is reversed, whereby the transport tray 54 with a CD, a DVD or the like placed thereon is transported from the recording medium ejection side. Due to the rigidity of the transport tray 54, the paper guide 109 suspended by a spring (not shown) is pushed down, and the transport tray is caused to pass the portion below the guide portion 108*b* of the U-turn transport unit casing 108 and the portion below the second U-turn transport roller 22, and is transported to a position in the vicinity of the paper guide 106.

Figure 20:
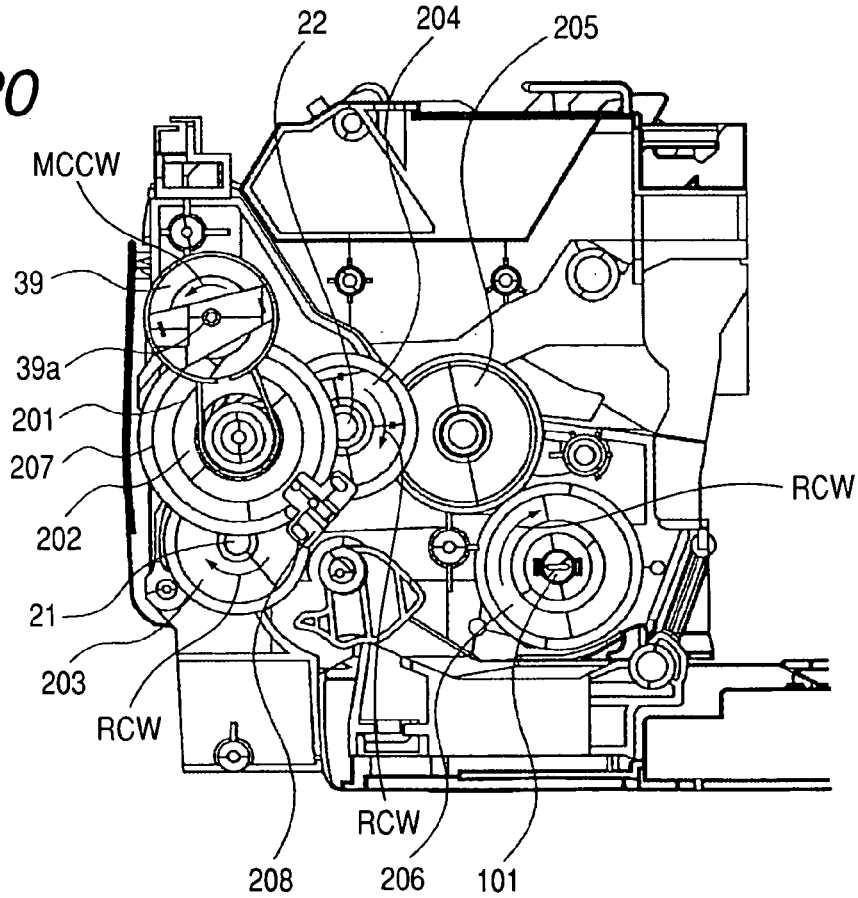
FIG. 20 is an explanatory view of a drive row from a drive motor to a U-turn transport roller.

Next, the drive row from the drive motor to the U-turn transport roller will be described with reference to FIG. 20. The output of the drive motor 39 is transmitted to a wheel gear 202 through a transmission belt 201 from a motor pulley (not shown) press-fitted onto the output shaft 39*a*, and is further transmitted to U-turn transport roller gears 203 and 204 respectively press-fitted onto the U-turn transport rollers 21 and 22. The driving force of the U-turn transport roller gear 204 is transmitted through an idle gear 205 to a duplex transport roller gear 206 arranged on the shaft of the duplex transport roller 101. That is, when the drive motor 39 rotates in the direction MCCW, the U-turn transport rollers 21 and 22 and the duplex transport roller 101 are all rotated in the direction RCW, in which the recording medium is transported. When the drive motor 39 is rotated in the reverse direction, the U-turn transport rollers 21 and 22 and the duplex transport roller 101 are also rotated in the reverse direction. A code wheel 207, which has printed thereon slits for detecting the recording medium transporting amount, that is, the rotating amount of the U-turn transport rollers 21 and 22, is press-fitted, upon accurate positioning, to the wheel gear 202 situated on the upstream side of the U-turn transport roller gears 203 and 204 press-fitted onto the U-turn transport rollers 21 and 22. Then, the slits caused to pass by the rotation of the code wheel 207 are detected by an encoder sensor 208. The drive motor 39 is feedback-controlled based on an output signal of the encoder sensor 208, thereby controlling the rotation of the U-turn transport rollers 21 and 22 and the duplex transport roller 101, that is, the transport amount of the recording medium.

Figure 21A:
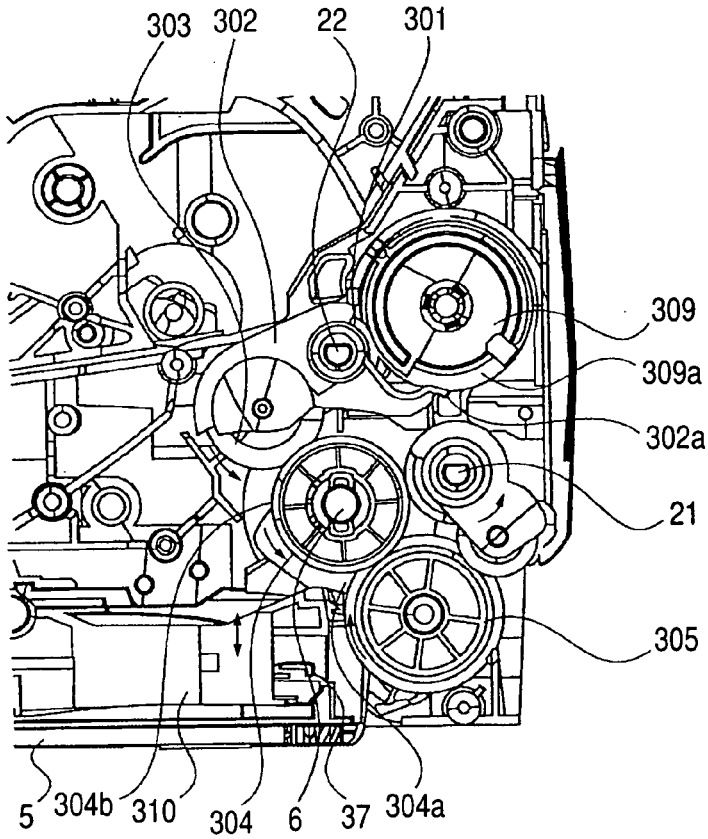
FIGS. 21A and 21B are explanatory views of a drive system.
Figure 21B:
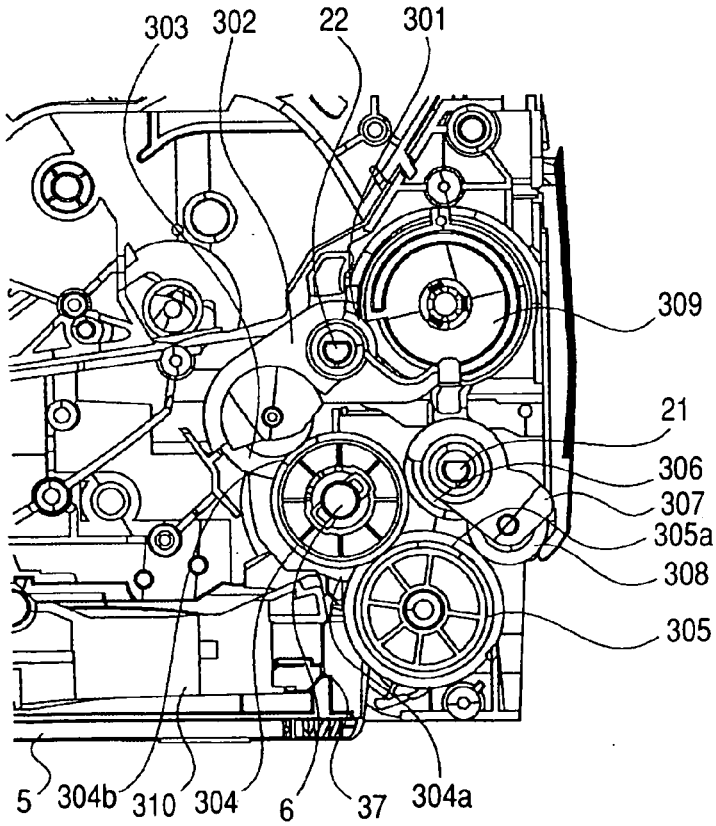

Next, the operation of feeding sheets from the sheet feeding cassette 5 will be described with reference to FIGS. 21A and 21B and FIGS. 22A through 22C. FIGS. 21A and 21B are diagrams illustrating the drive system, and FIGS. 22A through 22C are diagrams illustrating how the recording medium is transported.

In FIGS. 21A and 21B, a transport roller output gear 301 arranged on the shaft of the second U-turn transport roller 22 constitutes a sun gear, and driving force is transmitted to a U-turn sheet feeding roller gear 304, arranged on the shaft of the U-turn sheet feeding roller 6, by means of a swing arm 302, a planetary gear 303, and a friction spring (not shown). Here, reference numeral 309 indicates a controlling unit for ON/OFF-controlling the locking of the rotation of the swing arm 302; it is connected in driving to the transport roller output gear 301. Depending on the rotating direction and the rotating amount of the drive motor 39, an opening 309*a* appears or disappears. Only when a lever portion 302*a* of the swing arm 302 is situated at the opening 309*a*, it is possible for the planetary gear 303 and the U-turn sheet feeding roller gear 304 to be meshed with each other. This state is attained during the sheet feeding operation by the U-turn sheet feeding roller 6.

The U-turn sheet feeding roller gear 304 is equipped with a cam surface 304*a* adapted to lower an arm 310 for pushing up the middle plate 37 of the sheet feeding cassette 5; through balancing with a spring (not shown) pushing up the arm 310, the operations of raising and lowering the middle plate 37 are controlled by the rotation of the U-turn sheet feeding roller gear 304. Also on the opposite side of the U-turn sheet feeding roller 6, there is arranged a cam 2309 similar to that of the U-turn sheet feeding roller gear 2404, controlling the rising/lowering motion of the arm 310 and the middle plate 37 from the right and left sides with the same timing.

Figure 22A:
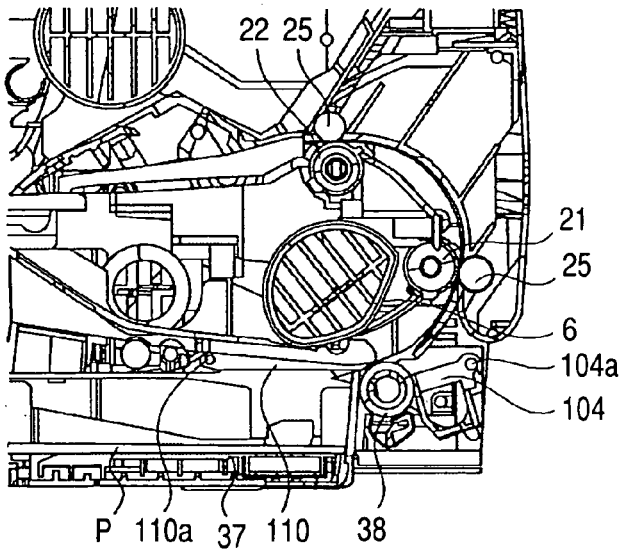
FIGS. 22A, 22B, and 22C are diagrams illustrating how a recording medium is transported.
Figure 22B:
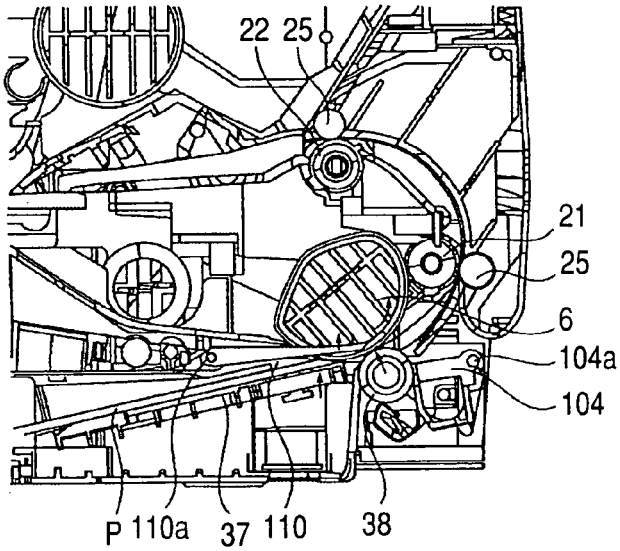
Figure 22C:
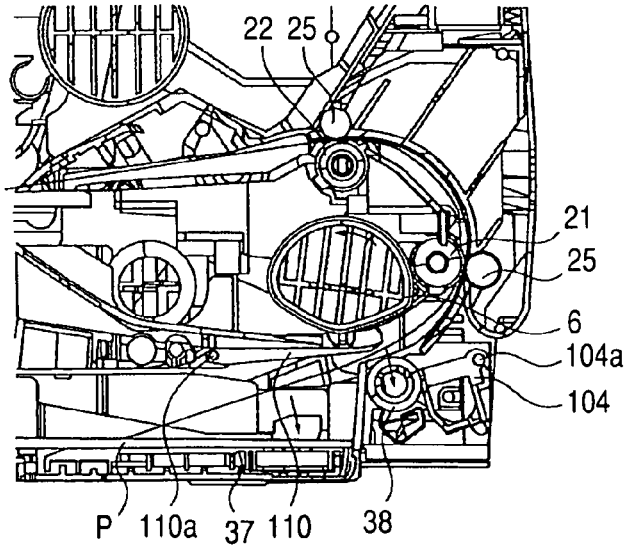

In FIG. 22A, the separation roller 38 is equipped with a torque limiter (not shown) so as to allow rotation in one direction only, and is rotatably mounted to a separation roller holder 104. Using a rotation center 104*a* as a fulcrum, the separation roller holder 104 is brought into and out of contact with the U-turn sheet feeding roller 6. The separation roller holder 104 is controlled to be brought into and out of contact with the U-turn sheet feeding roller 6 by means of a control gear 305 in mesh with the U-turn sheet feeding roller gear 2404. Further, by a cam (not shown) provided on the U-turn sheet feeding roller 6, a cam follower provided on the duplex transport flapper 110 is raised and lowered, whereby the duplex transport flapper 110 is raised and lowered around the rotation shaft 110*a* with the motion of the U-turn sheet feeding roller 6.

When the sheet feeding operation is started, the state of the drive system is changed from that shown in FIG. 22A to that shown in FIG. 22B. The middle plate 37, the separation roller 38, and the duplex transport flapper 110 are raised by the above-described mechanism. As a result, the recording medium P in the sheet feeding cassette 5 is fed by the U-turn sheet feeding roller 3. When the rotation of the drive motor 309 is continued, and the separation of the recording medium is completed, the drive system is brought into the state as shown in FIG. 21B. Here, the U-turn sheet feeding roller gear 304 has an untoothed portion 304*b*. When the untoothed portion 304*b* comes to a position where it is opposed to the planetary gear 303, the rotation of the U-turn sheet feeding roller gear 304 stops, and exclusively the U-turn transport rollers 21 and 22 and the duplex transport roller 101 rotate, and transport after sheet feeding and printing by the recording head are performed. At this time, the state in which the recording medium is transported has been changed to that shown in FIG. 22C. The separation roller 38 is placed away from the transport path, and does not come into contact with the recording medium except during sheet feeding operation, so that it does not constitute a resistance to transport. Further, the duplex transport flapper 110 is kept raised during both sheet feeding and U-turn transport, and continues transport. This helps to prevent defective feeding or skew feed due to transport resistance attributable to the influence of the weight of the duplex transport flapper 110.

Further, the U-turn sheet feeding roller 6 has a semicircular configuration; after the feeding of the recording medium P, the clearance portion of the semicircular roller is opposed to the recording medium. Due to this construction, the transport path is secured, and the transport of the recording medium P by the U-turn transport rollers 21 and 22 is not hindered. Thus, it is only necessary for the U-turn sheet feeding roller 6 to be endowed with a sheet transport performance, and the transport accuracy required of it is not so high.

Next, when the transport is completed, the drive motor 39 is rotated in the reverse direction in the state shown in FIG. 21B. A transport roller output gear 306 arranged on the shaft of the U-turn transport roller 21 constitutes a sun gear, and driving force is transmitted to a control gear 305 by a swing arm 307, a planetary gear 308, a friction gear (not shown), and a planetary gear 2408. The control gear 305 has an untoothed portion 305*a*, and is rotated until the planetary gear 308 comes to a position where it is opposed to the untoothed portion 305*a*. Further, the U-turn sheet feeding roller gear 304 also rotates, and the untoothed portion 304*a* is removed from the position where it is opposed to the planetary gear 303, so that sheet feeding operation is again possible through the next normal rotation of the drive motor 39 (i.e., the drive system is restored to the state as shown in FIG. 21A). Here, through cam operation due to the rotation of the U-turn sheet feeding roller gear 304, the duplex transport flapper 110 is lowered, making it possible to secure the duplex transport path (i.e., the drive system is restored to the state as shown in FIG. 22A). In this state also, due to the semicircular clearance portion of the U-turn sheet feeding roller 6, the U-turn transport path and the duplex transport path are secured.

Due to the above construction, despite the fact that the U-turn sheet feeding roller 6 and the separation roller 38 are situated in the duplex transport path, they do not come into contact with the recording medium during U-turn transport and duplex transport except during U-turn sheet feeding operation due to the semicircular configuration of the U-turn sheet feeding roller 6 and the movement of the separation roller 38 away from the transport path. Thus, even if the printing ink on the surface has not been dried yet, there is no fear of ink, etc. being transferred to the U-turn sheet feeding roller 6. Further, it is possible to suppress wear of the U-turn sheet feeding roller 6.

Next, the duplex transport will be described with reference to FIGS. 23A and 23B.

Figure 23A:
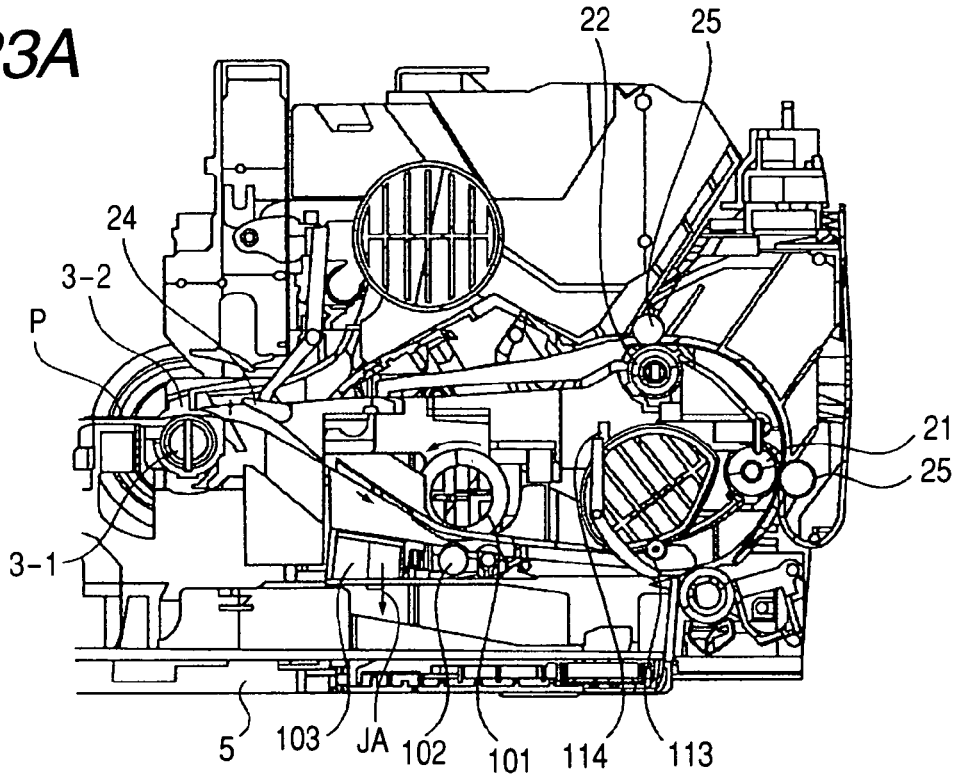
FIGS. 23A and 23B are diagrams illustrating how duplex transport is performed.

As shown in FIG. 23A, after the completion of printing on the obverse side of a recording medium, the paper guide flapper 24 is raised by a switching mechanism (not shown) to secure the entrance to the duplex transport path. Then, by rotating the main transport roller 3-1 in the reverse direction, the recording medium P the obverse side of which has undergone printing is transported to the duplex transport path below. At this time, the drive motor 39 is also rotated in synchronism therewith, whereby the recording medium is transported to the duplex transport roller 101 and the U-turn transport rollers 21 and 22. The second detection lever 113, arranged between the duplex transport roller 101 and the U-turn transport roller 21, detects whether the recording medium P is being transported or not.

Here, when the passage of the recording medium P cannot be detected by the second detection sensor 114, a paper jamming error display is given, calling attention for the necessity of removing the jammed recording medium. As the anti-jamming means, the sheet feeding cassette 5 is drawn out, and the paper guide 103 is opened in the direction JA, whereby the press contact of the two-side pinch roller 102 with the duplex transport roller 101 is canceled, making it possible to remove the jammed recording medium P. The paper guide 103 is suspended up above by a spring (not shown), and, when released by the user, returns to the original position, where it does not hinder the insertion of the cassette. In this way, a jam processing opening that can be opened and closed is provided between the sheet feeding cassette and the duplex transport path, whereby jamming can be coped with without using any such large-scale jam processing mechanism as would cause attachment/detachment of roller and units.

Figure 23B:
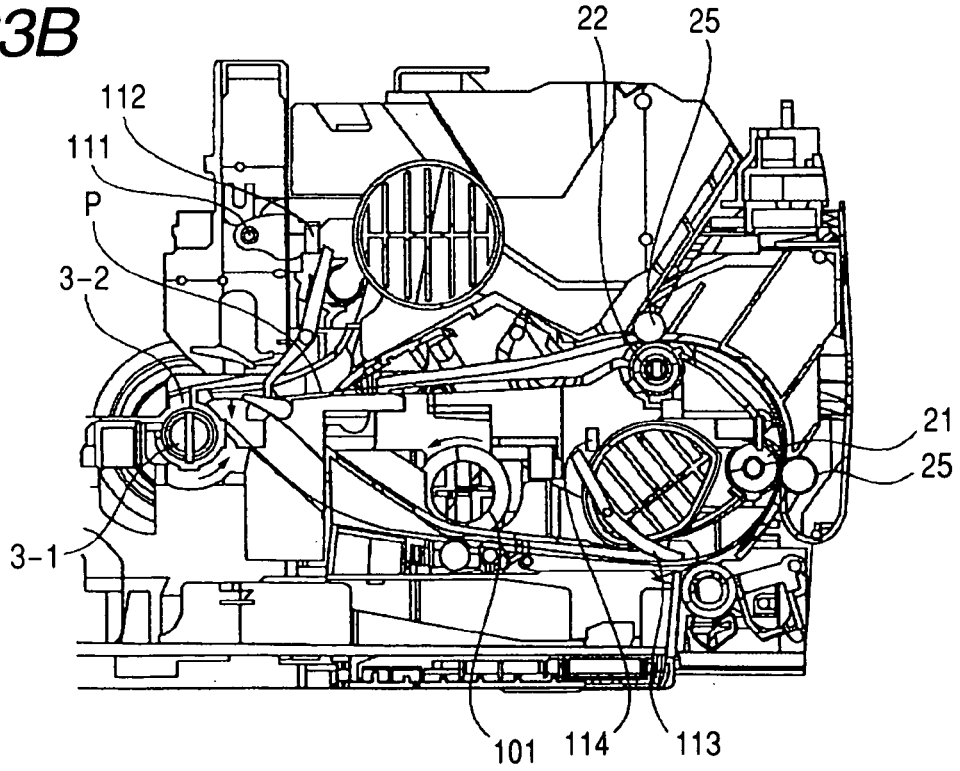
Figure 24:
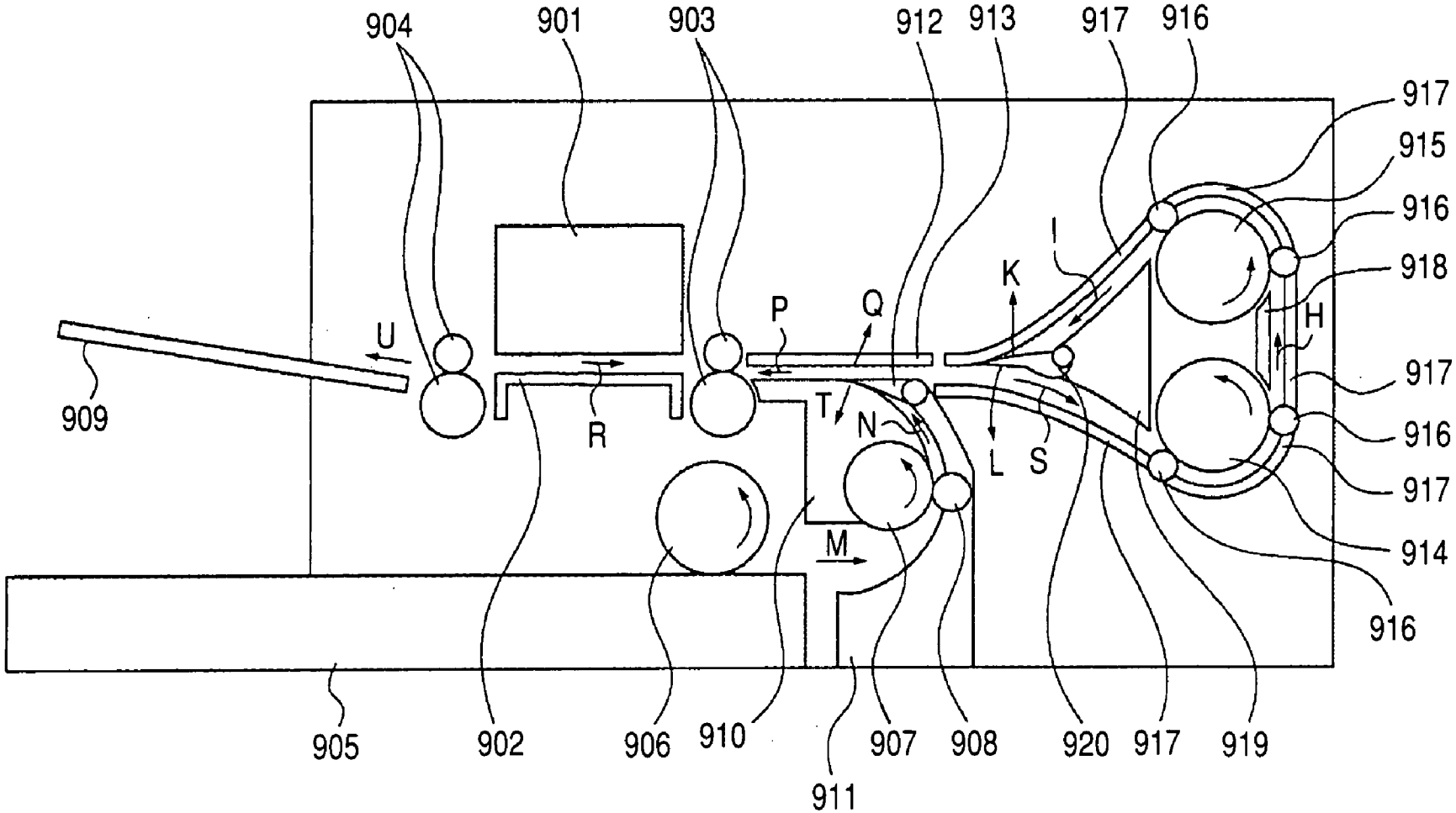
FIG. 24 is a sectional view of the main body of a conventional recording apparatus.

Next, when, as shown in FIG. 23B, the leading end of the recording medium P having passed the second U-turn transport roller 22 is detected by the second detection lever 111, the trailing end of the recording medium P has already passed the main transport roller pair 3. Then, the paper guide flapper 24 is lowered by a switching mechanism (not shown), and the main transport roller pair 3 is switched from reverse to normal rotation, causing the U-turn transport rollers 21 and 22 and the duplex transport roller 101 to make normal rotation, whereby the recording medium P is transported to the main transport roller pair 3 and printing becomes possible.

At this time, an opening 309*a* of a control ring unit 309 is closed. A lever portion 304*a* of a swing arm 304 is obstructed by the control ring unit 309, and the U-turn sheet feeding roller 6 is not driven. In this state, reverse side printing is performed, and the recording medium is ejected. When two-side printing has been completed or when the trailing end of the recording medium has passed the second U-turn transport roller 22, the opening 309*a* of the control ring unit 309 is opened, and the apparatus is made ready for sheet feeding.

Due to the above construction, it is possible to realize, with a simple structure, sheet feeding from the upper portion of the main body, U-turn sheet feeding, duplex transport, and the transport of a thick recording medium, such as a CD or a DVD. Further, this construction allows transport of recording mediums of various sizes, and it is possible to transport with high accuracy a high quality recording medium that does not easily bend even in the case of U-turn sheet feeding or duplex transport.

According to the above embodiments of the present invention, it is possible to provide a recording apparatus that helps to achieve a reduction in size and cost.

This application claims priority from Japanese Patent Application Nos. 2003-382533 filed Nov. 12, 2003 and 2004-238446 filed on Aug. 18, 2004, which are hereby incorporated by reference herein.

What is claimed is:

1. A recording apparatus comprising:

a sheet feeding roller for reversing and feeding a recording medium;

a main transport roller for transporting the recording medium on an upstream side of a recording head;

a reversing mechanism for turning the recording medium upside down;

a first transport path for transporting the recording medium from the sheet feeding roller to the main transport roller;

a second transport path for transporting the recording medium in the reversing mechanism, the second transport path sharing a portion thereof with the first transport path;

a third transport path arranged in the portion shared by the first and second transport paths; and a separation roller adapted to abut the sheet feeding roller to separate the recording medium, wherein during sheet feeding, the sheet feeding roller and the separation roller are in contact with each other, and when the recording medium is to be turned upside down, the sheet feeding roller and the separation roller are separated from each other.

2. A recording apparatus according to claim 1, further comprising a common transport roller provided inside the first transport path and the second transport path.

3. A recording apparatus according to claim 2, wherein the common transport roller and the third transport path overlap each other.

4. A recording apparatus according to claim 1, wherein the sheet feeding roller has a semicircular configuration.

5. A recording apparatus according to claim 1, further comprising a common guide means common to the first transport path and the second transport path, for guiding the recording medium.

6. A recording apparatus according to claim 5, wherein the common guide means is opened to an exterior of the recording apparatus for anti-jam processing.

7. A recording apparatus according to claim 1, further comprising a movable paper guide arranged at a position where the second transport path and the first transport path join each other, wherein a switching operation is conducted such that the paper guide is placed at a lowered position when the recording medium is to be turned upside down and is placed at a raised position when the recording medium is to be fed by the sheet feeding roller.

8. A recording apparatus according to claim 7, wherein the switching operation is conducted in synchronism with the sheet feeding operation.

9. A recording apparatus according to claim 7, wherein the position of the paper guide is switched according to a kind of recording medium.

10. A recording apparatus according to claim 1, further comprising a transport roller provided in the second transport path and between the main transport roller and the sheet feeding roller.

11. A recording apparatus according to claim 1, wherein the second transport path expands outwardly from a common tangent formed by the main transport roller and the first transport path.

12. A recording apparatus according to claim 1, further comprising a space provided in the second transport path, for effecting a change between a state in which the recording medium is nipped by the main transport roller and a state in which the recording medium has left a nip of the main transport roller.

13. A recording apparatus comprising:

a U-turn sheet feeding roller for reversing and feeding a recording medium;

a main transport roller for transporting the recording medium on an upstream side of a recording head;

a reversing mechanism for turning the recording medium upside down;

a first transport path for transporting the recording medium from the U-turn sheet feeding roller to the main transport roller;

a second transport path for transporting the recording medium in the reversing mechanism, the second transport path sharing a portion thereof with the first transport path;

a third transport path arranged in the portion shared by the first and second transport paths and adapted to transport a recording medium of high rigidity; and a movable paper guide arranged at a position where the second transport path and the first transport path join each other, wherein a switching operation is conducted such that the paper guide is placed at a lowered position when the recording medium is to be turned upside down and is placed at a raised position when the recording medium is to be fed by the U-turn sheet feeding roller.

* * * * *